US009214158B2

(12) United States Patent
Kishi et al.

(10) Patent No.: US 9,214,158 B2
(45) Date of Patent: Dec. 15, 2015

(54) AUDIO DECODING DEVICE AND AUDIO DECODING METHOD

(71) Applicant: FUJITSU LIMITED, Kawasaki-shi, Kanagawa (JP)

(72) Inventors: Yohei Kishi, Kawasaki (JP); Akira Kamano, Kawasaki (JP); Shunsuke Takeuchi, Kawasaki (JP); Miyuki Shirakawa, Fukuoka (JP); Masanao Suzuki, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 326 days.

(21) Appl. No.: 13/904,165

(22) Filed: May 29, 2013

(65) Prior Publication Data

US 2014/0029752 A1 Jan. 30, 2014

(30) Foreign Application Priority Data

Jul. 24, 2012 (JP) ..... 2012-164185

(51) Int. Cl.

| | |
|---|---|
| ***G10L 19/04*** | (2013.01) |
| ***G10L 19/008*** | (2013.01) |
| *G10L 25/12* | (2013.01) |
| *G10L 19/02* | (2013.01) |

(52) U.S. Cl.

CPC ..... *G10L 19/008* (2013.01); *G10L 19/0204* (2013.01); *G10L 19/04* (2013.01); *G10L 25/12* (2013.01)

(58) Field of Classification Search

CPC ..... G10L 19/008

See application file for complete search history.

(56) References Cited

U.S. PATENT DOCUMENTS

| | | | | |
|---|---|---|---|---|
| 2006/0140412 | A1* | 6/2006 | Villemoes et al. | 381/12 |
| 2006/0190247 | A1* | 8/2006 | Lindblom | 704/230 |
| 2009/0055194 | A1 | 2/2009 | Hotho et al. | |
| 2009/0119111 | A1 | 5/2009 | Goto et al. | |

(Continued)

FOREIGN PATENT DOCUMENTS

| | | |
|---|---|---|
| JP | 2007-212637 | 8/2007 |

OTHER PUBLICATIONS

ISO/IEC 14496-3:2005, "Information Technology—Coding of audio-visual objects—Part 3: Audio", International Standards Organization, Geneva, Switzerland, Dec. 2005.*

(Continued)

*Primary Examiner* — Brian Albertalli

(74) *Attorney, Agent, or Firm* — Oblon, McClelland, Maier & Neustadt, L.L.P.

(57) ABSTRACT

An audio decoding device includes a processor; and a memory which stores a plurality of instructions, which when executed by the processor, cause the processor to execute, decoding, using a first channel signal and a second channel signal included in a plurality of channels of an audio signal having a first frequency range and a second frequency range, a first prediction coefficient of the first frequency range and a second prediction coefficient of the second frequency range, both selected from a code book when prediction-encoding a third channel signal that is not subjected to prediction encoding and that is included in the plurality of channels; decoding a residual signal included in the first frequency range, the residual signal representing an error occurring in prediction encoding; and prediction-decoding the third channel signal subjected to prediction-encoding in the second frequency range from the first channel signal, the second channel signal.

20 Claims, 14 Drawing Sheets

(56) References Cited

U.S. PATENT DOCUMENTS

| | | | | |
|---|---|---|---|---|
| 2009/0125313 | A1* | 5/2009 | Hellmuth et al. | 704/501 |
| 2009/0299734 | A1* | 12/2009 | Zhou et al. | 704/201 |
| 2011/0040566 | A1* | 2/2011 | Moon et al. | 704/500 |
| 2011/0046964 | A1* | 2/2011 | Moon et al. | 704/500 |
| 2011/0103592 | A1* | 5/2011 | Kim et al. | 381/22 |
| 2011/0246139 | A1* | 10/2011 | Kishi et al. | 702/189 |
| 2012/0095769 | A1* | 4/2012 | Zhang et al. | 704/500 |

OTHER PUBLICATIONS

Extended European Search Report issued Oct. 25, 2013 in Patent Application No. 13171426.3.

Gerard Hotho, et al., "A backward-compatible multichannel audio codec", *IEEE Transactions on Audio, Speech, and Language Processing*, vol. 16, No. 1, Jan. 2008, pp. 83-93.

* cited by examiner

FIG. 2

| | | | | | | | | | | | | |
|---|---|---|---|---|---|---|---|---|---|---|---|---|
| idx | -20 | -19 | -18 | -17 | -16 | -15 | -14 | -13 | -12 | -11 | -10 | 201 |
| c [idx] | -2.0 | -1.9 | -1.8 | -1.7 | -1.6 | -1.5 | -1.4 | -1.3 | -1.2 | -1.1 | -1.0 | 202 |
| idx | -9 | -8 | -7 | -6 | -5 | -4 | -3 | -2 | -1 | 0 | 1 | 203 |
| c [idx] | -0.9 | -0.8 | -0.7 | -0.6 | -0.5 | -0.4 | -0.3 | -0.2 | -0.1 | 0.0 | 0.1 | 204 |
| idx | 2 | 3 | 4 | 5 | 6 | 7 | 8 | 9 | 10 | 11 | 12 | 205 |
| c [idx] | 0.2 | 0.3 | 0.4 | 0.5 | 0.6 | 0.7 | 0.8 | 0.9 | 1.0 | 1.1 | 1.2 | 206 |
| idx | 13 | 14 | 15 | 16 | 17 | 18 | 19 | 20 | 21 | 22 | 23 | 207 |
| c [idx] | 1.3 | 1.4 | 1.5 | 1.6 | 1.7 | 1.8 | 1.9 | 2.0 | 2.1 | 2.2 | 2.3 | 208 |
| idx | 24 | 25 | 26 | 27 | 28 | 29 | 30 | 209 | | | | |
| c [idx] | 2.4 | 2.5 | 2.6 | 2.7 | 2.8 | 2.9 | 3.0 | 210 | | | | |

200

FIG. 3

| idx | 0 | 1 | 2 | 3 | 4 | 5 | 6 | 7 |
|---|---|---|---|---|---|---|---|---|
| ICC[idx] | 1 | 0.937 | 0.84118 | 0.60092 | 0.36764 | 0 | -0.589 | -0.99 |

310

320

300

FIG. 4

| DIFFERENCE VALUE | idxicci |
|---|---|
| -7 | 11111111111111 |
| -6 | 11111111111110 |
| -5 | 111111111110 |
| -4 | 1111111110 |
| -3 | 1111110 |
| -2 | 11110 |
| -1 | 110 |
| 0 | 0 |

| DIFFERENCE VALUE | idxicci |
|---|---|
| 1 | 10 |
| 2 | 1110 |
| 3 | 111110 |
| 4 | 11111110 |
| 5 | 111111110 |
| 6 | 11111111110 |
| 7 | 1111111111110 |

400

FIG. 5

| | | | | | | | | | | | |
|---|---|---|---|---|---|---|---|---|---|---|---|
| Idx | -15 | -14 | -13 | -12 | -11 | -10 | -9 | -8 | -7 | -6 | -5 |
| CLD[idx] | -150 | -45 | -40 | -35 | -30 | -25 | -22 | -19 | -16 | -13 | -10 |
| Idx | -4 | -3 | -2 | -1 | 0 | 1 | 2 | 3 | 4 | 5 | 6 |
| CLD[idx] | -8 | -6 | -4 | -2 | 0 | 2 | 4 | 6 | 8 | 10 | 13 |
| Idx | 7 | 8 | 9 | 10 | 11 | 12 | 13 | 14 | 15 | | |
| CLD[idx] | 16 | 19 | 22 | 25 | 30 | 35 | 40 | 45 | 150 | | |

510
520
530
540
550
560
500

FIG. 9A

| | | PREDICTION COEFFICIENT | | STEREO FREQUENCY | | RESIDUAL SIGNAL | CORRECTION DETERMINATION | CORRECTION SOURCE FREQUENCY RANGE |
|---|---|---|---|---|---|---|---|---|
| | | c1(k) | c2(k) | $L_0(k,n)$ | $R_0(k,n)$ | | | |
| FREQUENCY RANGE | $k_8$ | 2.0 | 2.0 | $L_0(k_8,n)$ | $R_0(k_8,n)$ | Null | No | Null |
| | $k_7$ | -1.2 | 1.1 | $L_0(k_7,n)$ | $R_0(k_7,n)$ | Null | No | Null |
| | $k_6$ | 1.2 | 2.4 | $L_0(k_6,n)$ | $R_0(k_6,n)$ | Null | Yes | $k_{82}$ |
| | $k_5$ | 0.4 | 0.3 | $L_0(k_5,n)$ | $R_0(k_5,n)$ | Null | No | Null |
| | $k_4$ | 1.8 | 1.9 | $L_0(k_4,n)$ | $R_0(k_4,n)$ | $res(k_4,n)$ | Null | Null |
| | $k_3$ | 0.5 | 0.5 | $L_0(k_3,n)$ | $R_0(k_3,n)$ | $res(k_3,n)$ | Null | Null |
| | $k_2$ | 1.2 | 2.4 | $L_0(k_2,n)$ | $R_0(k_2,n)$ | $res(k_2,n)$ | Null | Null |
| | $k_1$ | -1.9 | 2.5 | $L_0(k_1,n)$ | $R_0(k_1,n)$ | $res(k_1,n)$ | Null | Null |

901

FIG. 9B

| | | PREDICTION COEFFICIENT | |
|---|---|---|---|
| | | c'1(k) | c'2(k) |
| FREQUENCY RANGE | $k_6$ | 1.1587 | 2.6846 |
| | $k_2$ | 1.1587 | 2.6846 |

902

AUDIO DECODING DEVICE AND AUDIO DECODING METHOD

CROSS-REFERENCE TO RELATED APPLICATION

This application is based upon and claims the benefit of priority of the prior Japanese Patent Application No. 2012-164185, filed on Jul. 24, 2012, the entire contents of which are incorporated herein by reference.

FIELD

The embodiments discussed herein are related to an audio decoding device, an audio decoding method, and a computer-readable recording medium storing an audio decoding computer program.

BACKGROUND

A decoding method for decoding an encoded multichannel audio signal into the original signal has been developed. Herein, the encoded audio signals are obtained by converting the original signals into a down-mixed main signal (a stereo frequency signal), a residual signal, and spatial information and, subsequently, encoding these signals.

For example, in order to encode a surround audio signal, such as a 5.1 ch audio signal, the MPEG surround standard (ISO/IEC23003-1) defined by ISO/IEC has been used. In the MPEG surround standard, a surround signal is converted into, for example, a 2-channel main signal contained in an original audio signal, a residual signal indicating an error component generated when the audio signal is prediction-encoded, and the spatial information and, thereafter, the signals and information are encoded. In an MPEG surround decoder, the surround audio signal is obtained by decoding the main signal, the residual signal, and the spatial information.

The residual signal indicates an error component generated when the audio signal is prediction-encoded. By using the residual signal when the surround audio signal is prediction-decoded, an error occurring during prediction-encoding may be corrected. Thus, the audio signal prior to prediction-encoding may be accurately reproduced.

SUMMARY

In accordance with an aspect of the embodiments, an audio decoding device includes a processor; and a memory which stores a plurality of instructions, which when executed by the processor, cause the processor to execute, decoding, using a first channel signal and a second channel signal included in a plurality of channels of an audio signal having a first frequency range and a second frequency range, a first prediction coefficient of the first frequency range and a second prediction coefficient of the second frequency range, both selected from a code book when prediction-encoding a third channel signal that is not subjected to prediction encoding and that is included in the plurality of channels; decoding a residual signal included in the first frequency range, the residual signal representing an error occurring in prediction encoding; and prediction-decoding the third channel signal subjected to prediction-encoding in the second frequency range from the first channel signal, the second channel signal, the third channel signal subjected to prediction encoding, the first prediction coefficient, and the residual signal of the first frequency range and the first channel signal and the second channel signal of the second frequency range.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

These and/or other aspects and advantages will become apparent and more readily appreciated from the following description of the embodiments, taken in conjunction with the accompanying drawing of which:

FIG. 2 is an example of a quantization table (a code book) for a prediction coefficient;

FIG. 3 illustrates an example of a quantization table related to the similarity;

FIG. 4 illustrates an example of a table indicating a relationship between a difference value between indices and a similarity code;

FIG. 5 illustrates an example of a quantization table for an intensity difference;

FIG. 9A is an example of a first data table stored in a prediction decoding unit;

FIG. 9B is an example of a second data table including corrected prediction coefficients $c'_1(k)$ and $c'_2(k)$ computed by a computing unit;

DESCRIPTION OF EMBODIMENTS

An audio decoding device, an audio decoding method, a computer-readable recording medium storing an audio decoding computer program, and an audio encoding and decoding system according to an exemplary embodiment are described below with reference to the accompanying drawings. Note that the scope of the disclosure is not to be construed as being limited to the following exemplary embodiment.

First Exemplary Embodiment

Figure 1:
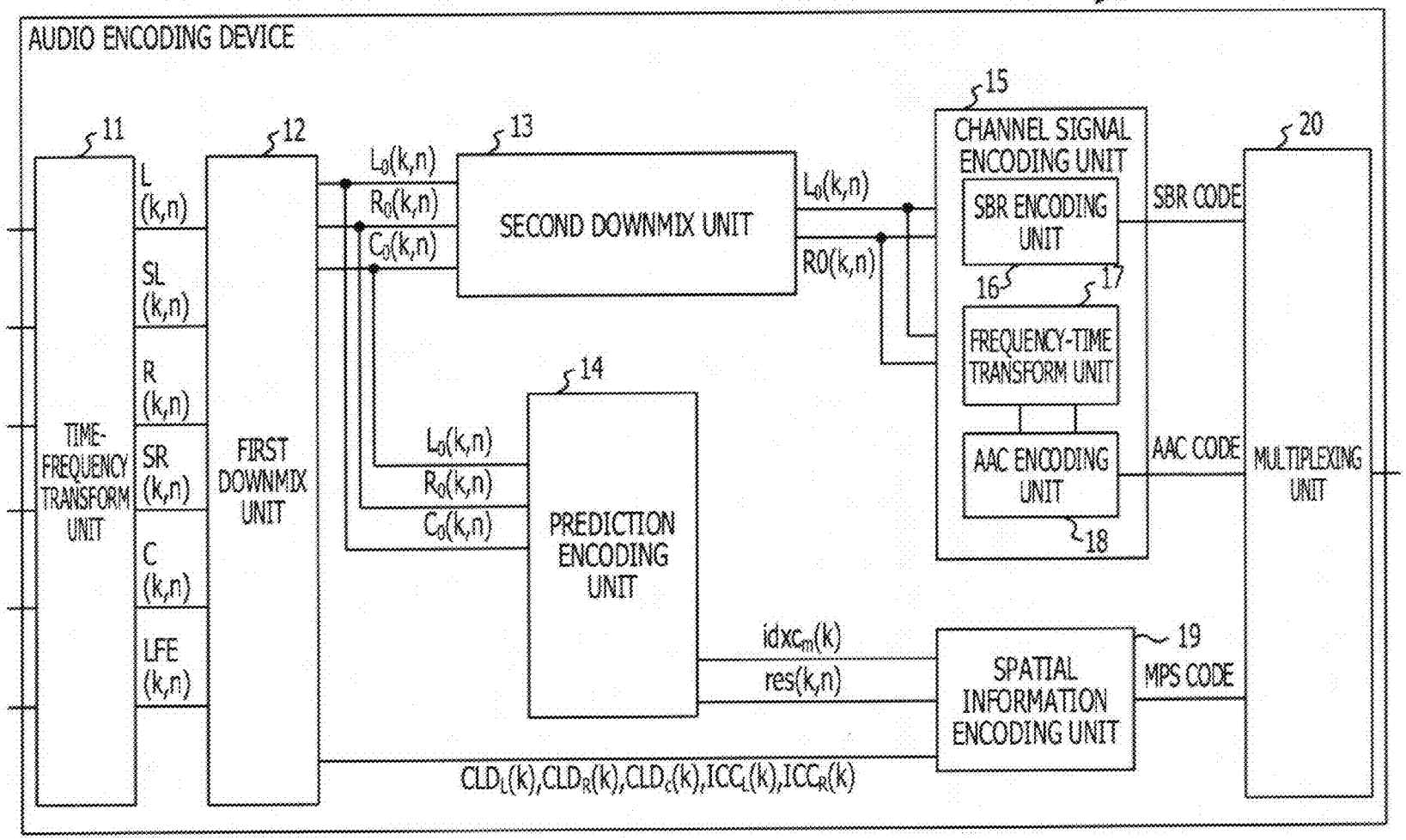
FIG. 1 is a functional block diagram of an audio encoding device corresponding to an audio decoding device according to an exemplary embodiment.

FIG. 1 is a functional block diagram of an audio encoding device 1 corresponding to an audio decoding device 2 (described in more detail below) according to an exemplary embodiment. To describe the data structure of data input to the audio decoding device 2 and some of the functions of an audio encoding and decoding system 100, the audio encoding device 1 is described first. As illustrated in FIG. 1, the audio encoding device 1 includes a time-frequency transform unit 11, a first downmix unit 12, a second downmix unit 13, a prediction encoding unit 14, a channel signal encoding unit 15, a spatial information encoding unit 19, and a multiplexing unit 20. The channel signal encoding unit 15 includes a spectral band replication (SBR) encoding unit 16, a frequency-time transform unit 17, and an advanced audio coding (AAC) encoding unit 18.

These units of the audio encoding device 1 are formed as independent circuits. Alternatively, these units of the audio encoding device 1 may be formed as a single integrated circuit having circuits of these units integrated therein, and the integrated circuit may be incorporated into the audio encoding device 1. Still alternatively, these units of the audio encoding device 1 may be formed as functional modules realized by a computer program executed by a processor included in the audio encoding device 1.

The time-frequency transform unit 11 performs time-frequency transform on a signal of each of the channels in a time domain of a multichannel audio signal input to the audio encoding device 1 on a frame basis. In this manner, the time-frequency transform unit 11 converts the signal into a frequency signal for each of the channels. According to the present exemplary embodiment, the time-frequency transform unit 11 converts a signal of each of the channels into a frequency signal using the following Quadrature Mirror Filter (QMF) filter bank:

$$QMF(k, n) = \exp\left[j\frac{\pi}{128}(k+0.5)(2n+1)\right], \quad 0 \le k < 64,\ 0 \le n < 128 \qquad \text{(Expression 1)}$$

where n represents a variable indicating a time (for example, when a one-frame audio signal is divided into 128 pieces in the time direction, n represents the n-th time). Note that the frame length may be set to a value in the range from 10 msec to 80 msec. In addition, k represents a variable indicating a frequency range (for example, when the frequency range of a frequency signal is divided into 64 pieces, k represents the k-th frequency range). In addition, QMF(k, n) represents a QMF for outputting the frequency signal of a frequency k at a time of n. By multiplying an audio signal for one frame in the input channel by QMF(k, n), the time-frequency transform unit 11 generates a frequency signal for the channel. Note that the time-frequency transform unit 11 may convert a signal of each of the channels using a different time-frequency transform process, such as fast Fourier transform, discrete cosine transform, or modified discrete cosine transform.

Each time the time-frequency transform unit 11 computes the frequency signals of all of the channels on a frame basis, the time-frequency transform unit 11 outputs the frequency signals for the channels to the first downmix unit 12.

Each time the first downmix unit 12 receives the frequency signals of all of the channels, the first downmix unit 12 downmixes the frequency signals of the channels. Thus, the first downmix unit 12 generates frequency signals for the left channel, the center channel, and the right channel. For example, the first downmix unit 12 generates frequency signals for the three channels as follows:

$$L_{in}(k,n)=L_{in\,Re}(k,n)+j\cdot L_{in\,Im}(k,n)\ 0\le k<64,\ 0\le n<128$$

$$L_{in\,Re}(k,n)=L_{Re}(k,n)+SL_{Re}(k,n)$$

$$L_{in\,Im}(k,n)=L_{Im}(k,n)+SL_{Im}(k,n)$$

$$R_{in}(k,n)=R_{in\,Re}(k,n)+j\cdot R_{in\,Im}(k,n)\ 0\le k<64,\ 0\le n<128$$

$$R_{in\,Re}(k,n)=R_{Re}(k,n)+SR_{Re}(k,n)$$

$$R_{in\,Im}(k,n)=R_{Im}(k,n)+SR_{Im}(k,n)$$

$$C_{in}(k,n)=C_{in\,Re}(k,n)+j\cdot C_{in\,Im}(k,n)\ 0\le k<64,\ 0\le n<128$$

$$C_{in\,Re}(k,n)=C_{Re}(k,n)+LFE_{Re}(k,n)$$

$$C_{in\,Im}(k,n)=C_{Im}(k,n)+LEE_{Im}(k,n) \qquad \text{(Expression 2)}$$

In the above-described expression, $L_{Re}(k, n)$ represents the real part of a frequency signal L(k, n) of the left front channel, and $L_{Im}(k, n)$ represents the imaginary part of the frequency signal L(k, n) of the left front channel. In addition, $SL_{Re}(k, n)$ represents the real part of a frequency signal SL(k, n) of the left rear channel, and $SL_{Im}(k, n)$ represents the imaginary part of the frequency signal SL(k, n) of the left rear channel. $L_{in}(k, n)$ represents the frequency signal of the left channel generated by downmixing. Note that $L_{inRe}(k, n)$ represents the real part of a frequency signal of the left channel, and $L_{inIm}(k, n)$ represents the imaginary part of the frequency signal of the left channel.

Similarly, $R_{Re}(k, n)$ represents the real part of a frequency signal R(k, n) of the right front channel, and $R_{Im}(k, n)$ represents the imaginary part of the frequency signal R(k, n) of the right front channel. In addition, $SR_{Re}(k, n)$ represents the real part of a frequency signal SR(k, n) of the right rear channel, and $SR_{Im}(k, n)$ represents the imaginary part of the frequency signal SR(k, n) of the right rear channel. $R_{in}(k, n)$ represents the frequency signal of the right channel generated by downmixing. Note that $R_{inRe}(k, n)$ represents the real part of a frequency signal of the right channel, and $R_{inIm}(k, n)$ represents the imaginary part of the frequency signal of the right channel.

Furthermore, $C_{Re}(k, n)$ represents the real part of a frequency signal C(k, n) of the center channel, and $C_{Im}(k, n)$ represents the imaginary part of the frequency signal C(k, n) of the center channel. In addition, $LFE_{Re}(k, n)$ represents the real part of a frequency signal LFE(k, n) of the bass sound channel, and $LFE_{Im}(k, n)$ represents the imaginary part of the frequency signal LFE(k, n) of the bass sound channel. $C_{in}(k, n)$ represents the frequency signal of the center channel generated by downmixing. Note that $C_{inRe}(k, n)$ represents the real part of a frequency signal $C_{in}(k, n)$ of the center channel, and $C_{inIm}(k, n)$ represents the imaginary part of the frequency signal $C_{in}(k, n)$ of the center channel.

In addition, as the spatial information between the frequency signals of two channels to be downmixed, the first downmix unit 12 computes the difference between the intensities of the frequency signals that represent sound localization information and a similarity between the frequency signals that represents the spread of sound for each of the frequency ranges. These spatial information items computed by the first downmix unit 12 are examples of 3-channel spatial information items. According to the present exemplary embodiment, the first downmix unit 12 computes an intensity difference $CLD_L(k)$ and a similarity $ICC_L(k)$ for the left channel as follows:

$$CLD_L(k) = 10\log_{10}\left(\frac{e_L(k)}{e_{SL}(k)}\right) \quad \text{(Expression 3)}$$

$$ICC_L(k) = \mathrm{Re}\left\{\frac{e_{LSL}(k)}{\sqrt{e_L(k)\cdot e_{SL}(k)}}\right\} \quad \text{(Expression 4)}$$

$$e_L(k) = \sum_{n=0}^{N-1} |L(k, n)|^2$$

$$e_{SL}(k) = \sum_{n=0}^{N-1} |SL(k, n)|^2$$

$$e_{LSL}(k) = \sum_{n=0}^{N-1} L(k, n)\cdot SL(k, n)$$

where N represents the number of sample points included in a frame in the time direction. According to the present exemplary embodiment, N is 128. In addition, $e_L(k)$ represents the autocorrelation value of the frequency signal L(k, n) of the left front channel, and $e_{sL}(k)$ represents the autocorrelation value of the frequency signal SL(k, n) of the left rear channel. Furthermore, $e_{LSL}(k)$ represents the cross-correlation value between the frequency signal L(k, n) of the left front channel and the frequency signal SL(k, n) of the left rear channel.

Similarly, the first downmix unit 12 computes an intensity difference $CLD_R(k)$ and a similarity $ICC_R(k)$ of the frequency range k for the right channel as follows:

$$CLD_R(k) = 10\log_{10}\left(\frac{e_R(k)}{e_{SR}(k)}\right) \quad \text{(Expression 5)}$$

$$ICC_R(k) = \mathrm{Re}\left\{\frac{e_{RSR}(k)}{\sqrt{e_R(k)\cdot e_{SR}(k)}}\right\} \quad \text{(Expression 6)}$$

$$e_R(k) = \sum_{n=0}^{N-1} |R(k, n)|^2$$

$$e_{SR}(k) = \sum_{n=0}^{N-1} |SR(k, n)|^2$$

$$e_{RSR}(k) = \sum_{n=0}^{N-1} L(k, n)\cdot SR(k, n)$$

where $e_R(k)$ represents the autocorrelation value of the frequency signal R(k, n) of the right front channel, and $e_{sR}(k)$ represents the autocorrelation value of the frequency signal SR(k, n) of the right rear channel. In addition, $e_{RSR}(k)$ represents the cross-correlation value between the frequency signal R(k, n) of the right front channel and the frequency signal SR(k, n) of the right rear channel.

Furthermore, the first downmix unit 12 computes an intensity difference $CLD_C(k)$ of the frequency range k for the center channel as follows:

$$CLD_C(k) = 10\log_{10}\left(\frac{e_C(k)}{e_{LFE}(k)}\right) \quad \text{(Expression 7)}$$

$$e_C(k) = \sum_{n=0}^{N-1} |C(k, n)|^2$$

$$e_{LFE}(k) = \sum_{n=0}^{N-1} |LFE(k, n)|^2$$

where $e_C(k)$ represents the autocorrelation value of the frequency signal C(k, n) of the center channel, and $e_{LFE}(k)$ represents the autocorrelation value of the frequency signal LFE(k, n) of a low-frequency effects channel.

After generating the frequency signals for the three channels, the first downmix unit 12 further downmixes the frequency signal of the left channel and the frequency signal of the center channel. Thus, the first downmix unit 12 generates a left-side frequency signal of a stereo frequency signals. In addition, the first downmix unit 12 further downmixes the frequency signal of the right channel and the frequency signal of the center channel. Thus, the first downmix unit 12 generates a right-side frequency signal of the stereo frequency signals. For example, the first downmix unit 12 generates a left-side frequency signal $L_0(k, n)$ and a right-side frequency signal $R_0(k, n)$ and computes a signal $C_0(k, n)$ of the center channel used for, for example, selecting a prediction coefficient included in a code book as follows:

$$\begin{pmatrix} L_0(k, n) \\ R_0(k, n) \\ C_0(k, n) \end{pmatrix} = \begin{pmatrix} 1 & 0 & \frac{\sqrt{2}}{2} \\ 0 & 1 & \frac{\sqrt{2}}{2} \\ 1 & 1 & -\frac{\sqrt{2}}{2} \end{pmatrix} \begin{pmatrix} L_{in}(k, n) \\ R_{in}(k, n) \\ C_{in}(k, n) \end{pmatrix} \quad \text{(Expression 8)}$$

In the expression above, $L_{in}(k, n)$, $R_{in}(k, n)$, and $C_{in}(k, n)$ represent the frequency signals of the left, right, and center channels, respectively, generated by the first downmix unit 12. The left-side frequency signal $L_0(k, n)$ is generated by mixing the left front channel frequency signal, the left rear channel frequency signal, the center channel frequency signal, and the low-frequency effects channel frequency signal of the original multichannel audio signal. Similarly, the right-side frequency signal $R_0(k, n)$ is generated by mixing the right front channel frequency signal, the right rear channel frequency signal, the center channel frequency signal, and the low-frequency effects channel frequency signal of the original multichannel audio signal.

The first downmix unit 12 outputs the left-side frequency signal $L_0(k, n)$, the right-side frequency signal $R_0(k, n)$, and the center channel signal $C_0(k, n)$ to the second downmix unit 13. In addition, the first downmix unit 12 outputs the intensity differences $CLD_L(k)$, $CLD_R(k)$, and $CLD_C(k)$ and the similarities $ICC_L(k)$ and $ICC_R(k)$ representing the spatial information to the spatial information encoding unit 19.

The second downmix unit 13 downmixes two of the three frequency signals received from the first downmix unit 12, that is, the left-side frequency signal $L_0(k, n)$, the right-side frequency signal $R_0(k, n)$, and the center channel signal $C_0(k, n)$, to generate 2-channel stereo frequency signals. For example, the 2-channel stereo frequency signal is generated from the left-side frequency signal $L_0(k, n)$ and the right-side frequency signal $R_0(k, n)$. Thereafter, the second downmix unit 13 outputs the generated stereo frequency signal to the channel signal encoding unit 15.

The prediction encoding unit 14 selects, from the code book, the prediction coefficients for the frequency signals of the two channels that are downmixed by the second downmix unit 13. In order to prediction-encode the center channel signal $C_0(k, n)$ from the left-side frequency signal $L_0(k, n)$ and the right-side frequency signal $R_0(k, n)$, the second downmix unit 13 downmixes the right-side frequency signal $R_0(k, n)$ and the left-side frequency signal $L_0(k, n)$ and generates a 2-channel stereo frequency signal. Note that when the prediction encoding unit 14 performs prediction encoding, the prediction encoding unit 14 selects, from the code book using $C_0(k, n)$, $L_0(k, n)$, and $R_0(k, n)$, prediction coefficients $c_1(k)$ and $c_2(k)$ that minimizes an error d(k) between the frequency signals before and after prediction encoding for each of the frequency ranges. In this manner, the prediction encoding unit 14 obtains a prediction-encoded center channel signal $C'_0(k, n)$. The error d(k) and the prediction-encoded center channel signal $C'_0(k, n)$ are defined as follows:

$$d(k) = \sum_k \sum_n \{|C_0(k, n) - C'_0(k, n)|^2\} \quad \text{(Expression 9)}$$

$$C'_0(k, n) = c_1(k) \cdot L_0(k, n) + c_2(k) \cdot R_0(k, n)$$

If a real part and an imaginary part are used, Expression 9 may be expressed as follows:

$$C'_0(k,n)=C'_{0\,Re}(k,n)+C'_{0\,Im}(k,n)$$

$$C'_{0\,Re}(k,n)=c_1\times L_{0\,Re}(k,n)+c_2\times R_{0\,Re}(k,n)$$

$$C'_{0\,Im}(k,n)=c_1\times L_{0\,Im}(k,n)+c_2\times R_{0\,Im}(k,n) \quad \text{(Expression 10)}$$

where $L_{0\,Re}$ represents the real part of $L_0$, $L_{0\,Im}$ represents the imaginary part of $L_0$, $R_{0Re}$ represents the real part of $R_0$, and $R_{0\,Im}$ represents the imaginary part of $R_0$.

In addition, the prediction encoding unit 14 generates a residual signal res(k, n) used to correct the error d(k) in a decoder. The residual signal res(k, n) may be expressed using the center channel signal $C_0(k, n)$ before prediction encoding and the prediction-encoded center channel signal $C'_0(k, n)$ after the prediction encoding as follows:

$$\text{res}(k,n)=C_0(k,n)-C'_0(k,n) \quad \text{(Expression 11)}$$

The prediction encoding unit 14 outputs the computed residual signal res(k, n) to the spatial information encoding unit 19. Note that the prediction encoding unit 14 may compute the residual signals res(k, n) for all of the frequency ranges. Alternatively, in order to increase the coding efficiency, the prediction encoding unit 14 may compute the residual signal res(k, n) for some of the frequency ranges. For example, in Expression 1, the residual signals res(k, n) may be computed for the frequency ranges having k=1 to 32. Alternatively, the residual signals res(k, n) may be computed for the frequency ranges having k=33 to 64. According to the first exemplary embodiment, the residual signals res(k, n) are computed for k=1 to 32 or k=33 to 64. Hereinafter, for convenience of description, the frequency range for which the prediction encoding unit 14 generates the residual signal res (k, n) is referred to as a "first frequency range", and the frequency range for which the prediction encoding unit 14 does not generate the residual signal res(k, n) is referred to as a "second frequency range".

The prediction encoding unit 14 includes a quantization table (the code book) that indicates a relationship between each of the representative values of the prediction coefficients $c_1(k)$ and $c_2(k)$ and an index value. The prediction encoding unit 14 refers to the quantization table using the prediction coefficients $c_1(k)$ and $c_2(k)$ included in the code book. By referring to the quantization table, the prediction encoding unit 14 determines an index value that is the closest to the prediction coefficients $c_1(k)$ and $c_2(k)$ for each of the frequency ranges. More specifically, FIG. 2 illustrates an example of the quantization table (the code book) for the prediction coefficient. In a quantization table 200 illustrated in FIG. 2, each of the entries in rows 201, 203, 205, 207, and 209 contains an index value. In contrast, each of the entries in rows 202, 204, 206, 208, and 210 contains the representative value of the prediction coefficient corresponding to the index value indicated in one of the entries of the rows 201, 203, 205, 207, and 209 in the same column. For example, if the prediction coefficient $c_1(k)$ for the frequency range k is 1.2, the prediction encoding unit 14 sets the index value for the prediction coefficient $c_1(k)$ to 12.

Subsequently, the prediction encoding unit 14 computes a difference value between the indices in the frequency direction for each of the frequency ranges. For example, when the index value for the frequency range k is 2 and if the index value for the frequency range (k−1) is 4, the prediction encoding unit 14 sets the index difference value for the frequency range k to −2.

Thereafter, the prediction encoding unit 14 refers to a coding table indicating a correspondence between an index difference value and a prediction coefficient code. By referring to the coding table, the prediction encoding unit 14 determines a prediction coefficient code $idxc_m(k)$ (m=1, 2 or m=1) for the difference value for each of the frequency ranges k of a prediction coefficient $c_m(k)$ (m=1, 2 or m=1). Like the similarity code, the prediction coefficient code may be a variable-length code having a decreasing code length corresponding to increasing appearance frequency of a difference value, such as Huffman code or arithmetic code. Note that the quantization table and the coding table are prestored in a memory (not illustrated) of the prediction encoding unit 14. As illustrated in FIG. 1, the prediction encoding unit 14 outputs the prediction coefficient code $idxc_m(k)$ (m=1, 2) to the spatial information encoding unit 19.

The second downmix unit 13 downmixes two of the three frequency signals, that is, the left-side frequency signal $L_0(k, n)$, the right-side frequency signal $R_0(k, n)$, and the center channel signal $C_0(k, n)$, to generate a 2-channel stereo frequency signal. More specifically, the second downmix unit 13 outputs, for example, the left-side frequency signal $L_0(k, n)$ and the right-side frequency signal $R_0(k, n)$ serving as a stereo frequency signal to the channel signal encoding unit 15.

The channel signal encoding unit 15 encodes the stereo frequency signal received from the second downmix unit 13. Note that the channel signal encoding unit 15 includes the SBR encoding unit 16, the frequency-time transform unit 17, and the AAC encoding unit 18.

Each time the SBR encoding unit 16 receives the stereo frequency signal, the SBR encoding unit 16 encodes a high-frequency component of the stereo frequency signal (a component included in the high-frequency range) using an SBR coding technique for each of the channels. Thus, the SBR encoding unit 16 generates an SBR code. For example, as described in Japanese Laid-open Patent Publication No. 2008-224902, the SBR encoding unit 16 makes a copy of a low frequency component of the frequency signal of each of the channels having a strong correlation with the high frequency component to be SBR-coded. Note that the low frequency component is a component of the frequency signal of each of the channels included in a low frequency range that is lower than the high frequency range including the high frequency component to be encoded by the SBR encoding unit 16. The low frequency component is encoded by the AAC encoding unit 18 (described in more detail below). Thereafter, the SBR encoding unit 16 adjusts the power of the duplicated high frequency component so that the power of the duplicated high frequency component is the same as the power of the original high frequency component. In addition, the SBR encoding unit 16 considers, as auxiliary information, a high frequency component among the original high frequency components that is difficult to approximate the original even when the low frequency component is copied due to a large difference from the low frequency component. Thereafter, the SBR encoding unit 16 encodes information indicating a positional relationship between the low frequency component used for copying and a corresponding high frequency component, a power adjustment amount, and the auxiliary information by quantizing the information. Subsequently, the SBR encoding unit 16 outputs SBR code representing the above-described encoded information to the multiplexing unit 20.

Each time the frequency-time transform unit 17 receives the stereo frequency signal, the frequency-time transform unit 17 converts the stereo frequency signal for each of the channels into a stereo signal in the time domain. For example, when the time-frequency transform unit 11 uses a QMF filter bank, the frequency-time transform unit 17 performs frequency-time transform on the stereo frequency signal of each of the channels using the following complex QMF filter bank:

$$IQMF(k, n) = \frac{1}{64}\exp\left(j\frac{\pi}{128}(k+0.5)(2n-255)\right), \quad 0 \le k < 64,\ 0 \le n < 128 \qquad \text{(Expression 12)}$$

where IQMF(k, n) represents a complex QMF having a time n and a frequency k as variables. Note that if the time-frequency transform unit 11 uses a different time-frequency transform process, such as fast Fourier transform, discrete cosine transform, or modified discrete cosine transform, the frequency-time transform unit 17 uses the inverse transform of the different time-frequency transform process. The frequency-time transform unit 17 obtains a stereo signal of each of the channels by performing frequency-time transform on the frequency signal of the channel and outputs the stereo signal to the MC encoding unit 18.

Each time the AAC encoding unit 18 receives the stereo signal of each of the channels, the AAC encoding unit 18 encodes the low frequency component of the signal of the channel using the AAC coding technique. Thus, the AAC encoding unit 18 generates an AAC code. Accordingly, the AAC encoding unit 18 may use the technique described in, for example, Japanese Laid-open Patent Publication No. 2007-183528. More specifically, the AAC encoding unit 18 performs discrete cosine transform on the received stereo signal of each of the channels and reconstructs a stereo frequency signal. Thereafter, the AAC encoding unit 18 computes the perceptual entropy (PE) from the reconstructed stereo frequency signal. PE represents the amount of information used to quantize a block without a listener perceiving any noise.

PE has characteristics so as to have a large value for sound having a signal level that varies in a short time, such as attack transients (for example, percussive attack transients). Accordingly, for a frame having a relatively large PE value, the AAC encoding unit 18 reduces the window. In contrast, for a frame having a relatively small PE value, the AAC encoding unit 18 increases the window. For example, a short window includes 256 samples, and a long window includes 2048 samples. The AAC encoding unit 18 performs modified discrete cosine transform (MDCT) on a stereo signal of each of the channels using a window having a determined length and converts the stereo signal to a set of MDCT coefficients. Thereafter, the AAC encoding unit 18 quantizes the set of MDCT coefficients and variable-length-encodes the quantized set of MDCT coefficients. Subsequently, the AAC encoding unit 18 outputs the variable-length-encoded set of MDCT coefficients and information regarding the quantization coefficient to the multiplexing unit 20 in the form of an AAC code.

The spatial information encoding unit 19 generates MPEG Surround code (hereinafter referred to as "MPS code") from the spatial information received from the first down-mix unit 12 and the prediction coefficient code received from the prediction encoding unit 14.

The spatial information encoding unit 19 refers to the quantization table indicating a correspondence between the value of similarity in the spatial information and the index value. By referring to the quantization table, the spatial information encoding unit 19 determines the index value that is the closest to the similarity value $ICC_i(k)$ (i=L, R, 0) for each of the frequency ranges. Note that the quantization table is prestored in, for example, a memory (not illustrated) of the spatial information encoding unit 19.

FIG. 3 illustrates an example of the quantization table related to the similarity. In a quantization table 300 illustrated in FIG. 3, each of the entries in an upper row 310 contains an index value, and each of the entries in a lower row 320 contains the representative value of the similarity corresponding to the index value in the same column. The similarity value is in a range from −0.99 to +1. For example, according to the quantization table 300, when the similarity value for the frequency range k is 0.6, the representative value of the similarity corresponding to the index 3 is the closest to the similarity value for the frequency range k. Thus, the spatial information encoding unit 19 sets the index value for the frequency range k to 3.

Subsequently, the spatial information encoding unit 19 computes a difference value between two indices along the frequency direction for each of the frequency ranges. For example, when the index value for the frequency range k is 3 and if the index value for the frequency range (k−1) is 0, the spatial information encoding unit 19 sets the difference value between the indices for the frequency range k to 3.

The spatial information encoding unit 19 refers to the coding table indicating a correspondence between a difference value between indices and a similarity code. By referring to the coding table, the spatial information encoding unit 19 determines the similarity code $idxicc_i(k)$ (i=L, R, 0) for the difference value between indices for each of the frequencies having a similarity $ICC_i(k)$ (i=L, R, 0). Note that the coding table is prestored in, for example, the memory of the spatial information encoding unit 19. In addition, the similarity code may be a variable-length code having an increasing code length corresponding to decreasing appearance of the difference value, such as Huffman code or arithmetic code.

FIG. 4 illustrates an example of a table indicating a relationship between a difference value between indices and the similarity code. In the example illustrated in FIG. 4, the similarity code is Huffman code. As illustrated in FIG. 4, in a coding table 400, each of the entries in the left column contains a difference value between indices, and each of the entries in the right column contains the similarity code corresponding to the difference value between indices in the same row. For example, when the difference value between indices for the similarity $ICC_L(k)$ of the frequency range k is 3, the spatial information encoding unit 19 refers to the coding table 400 and sets the similarity code $idxicc_L(k)$ for the similarity $ICC_L(k)$ to "111110".

The spatial information encoding unit 19 refers to the quantization table indicating a relationship between a value of intensity difference and an index value. By referring to the quantization table, the spatial information encoding unit 19 determines the index value that is the closest to the intensity difference $CLD_j(k)$ (j=L, R, C, 1, 2) for the frequency range k. Thereafter, the spatial information encoding unit 19 computes a difference value between indices along the frequency direction for each of the frequency ranges. For example, when the index value for the frequency range k is 2 and if the index value for the frequency range (k−1) is 4, the spatial information encoding unit 19 sets the difference value between indices for the frequency range k to −2.

The spatial information encoding unit 19 refers to the coding table indicating a relationship between a difference value between indices and an intensity difference code. By referring to the coding table, the spatial information encoding unit 19 determines an intensity difference code $idxcld_j(k)$ (j=L, R, C) of the intensity difference $CLD_j(k)$ for each of the frequency ranges k. Like the similarity code, the intensity difference code may be a variable-length code having a decreasing code length corresponding to increasing appearance of the difference value, such as Huffman code or arithmetic code. Note that the quantization table and the coding table are prestored in the memory of the spatial information encoding unit 19.

FIG. 5 illustrates an example of the quantization table for an intensity difference. As illustrated in FIG. 5, in a quantization table 500, each of the entries of rows 510, 530, and 550 contains an index value. The entries in rows 520, 540, and 560 contain the representative values of an intensity difference corresponding to the index values in the rows 510, 530, and 550 and in the same columns, respectively. For example, according to the quantization table 500, if the intensity difference $CLD_L(k)$ for the frequency range k is 10.8 dB, the representative value of the intensity difference corresponding to the index value 5 is the closest to $CLD_L(k)$. Accordingly, the spatial information encoding unit 19 sets the index value for $CLD_L(k)$ to 5.

The spatial information encoding unit 19 encodes the residual signal res(k, n) and generates the residual code. In addition, the spatial information encoding unit 19 generates the MPS code using the residual code, the similarity code $idxicc_i(k)$, the intensity difference code $idxcld_j(k)$, and the prediction coefficient code $idxc_m(k)$. For example, the spatial information encoding unit 19 generates the MPS code by arranging the similarity code $idxicc_i(k)$, the intensity difference code $idxcld_j(k)$, and the prediction coefficient code $idxc_m(k)$ in a predetermined order. The predetermined order is described in, for example, ISO/IEC23003-1:2007. Thereafter, the spatial information encoding unit 19 outputs the generated MPS code to the multiplexing unit 20.

Figure 6:
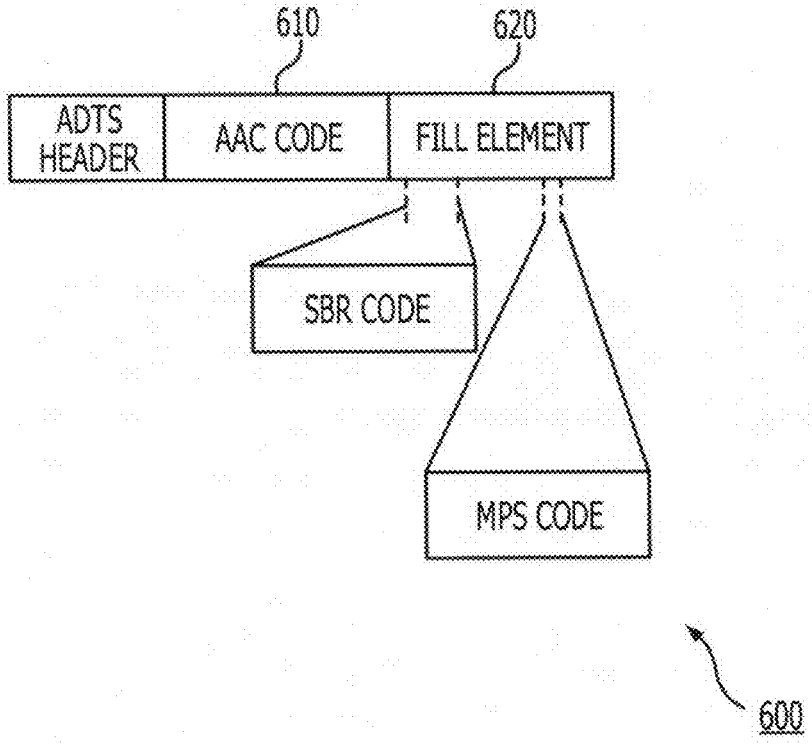
FIG. 6 illustrates an example of a data structure including an encoded audio signal.

The multiplexing unit 20 multiplexes the AAC code, the SBR code, and the MPS code by arranging these codes in a predetermined order. Thereafter, the multiplexing unit 20 outputs the encoded audio signal generated through the multiplexing operation. FIG. 6 illustrates an example of the data structure including the encoded audio signal. In the example of FIG. 6, the encoded audio signal is generated in accordance with the MPEG-4 Audio Data Transport Stream (ADTS) format. In a coded data string 600 illustrated in FIG. 6, the AAC code is stored in a data block 610. In addition, the SBR code and the MPS code are stored in part of the area of a block 620 including a FILL element of the ADTS format.

Figure 7:
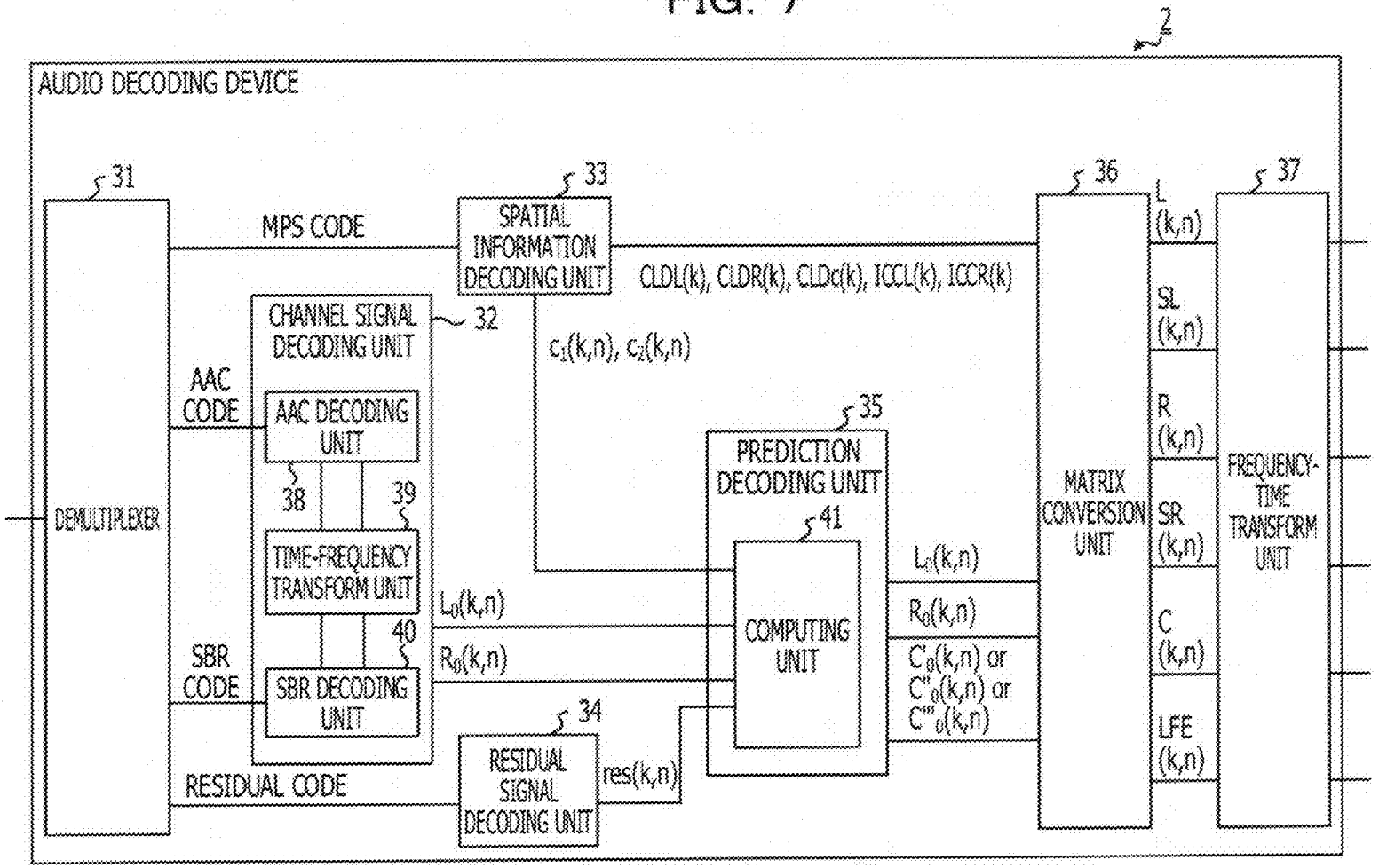
FIG. 7 is a functional block diagram of the audio decoding device according to an exemplary embodiment.

FIG. 7 is a functional block diagram of the audio decoding device 2 according to an exemplary embodiment. As illustrated in FIG. 7, the audio decoding device 2 includes a demultiplexer 31, a channel signal decoding unit 32, a spatial information decoding unit 33, a residual signal decoding unit 34, a prediction decoding unit 35, a matrix conversion unit 36, and a frequency-time transform unit 37. The channel signal decoding unit 32 includes an AAC decoding unit 38, a time-frequency transform unit 39, and an SBR decoding unit 40. The prediction decoding unit 35 includes a computing unit 41.

These units of the audio decoding device 2 are formed as independent circuits. Alternatively, these units of the audio decoding device 2 may be formed as a single integrated circuit unit having circuits of these units integrated into the audio decoding device 2. Still alternatively, these units of the audio decoding device 2 may be formed as functional modules realized by a computer program executed by a processor included in the audio decoding device 2.

The demultiplexer 31 receives a coded audio signal illustrated in FIG. 6 from the outside. The demultiplexer 31 demultiplexes the MPS code including the encoded AAC code, SBR code, and residual code included in the coded audio signal. The AAC code and SBR code may be referred to as a "channel coded signal", and the MPS code may be referred to as "coded spatial information". Note that as a demultiplexing method, a technique described in ISO/IEC14496-3 may be employed. The demultiplexer 31 outputs the MPS code other than the decoded residual code to the spatial information decoding unit 33, the AAC code to the AAC decoding unit 38, the SBR code other than the residual code to the SBR decoding unit 40, and the residual code to the residual signal decoding unit 34.

The spatial information decoding unit 33 receives the MPS code other than the residual code from the demultiplexer 31. Thereafter, the spatial information decoding unit 33 decodes the prediction coefficients $c_1(k)$ and $c_2(k)$ from the MPS code using the example of the quantization table for a prediction coefficient illustrated in FIG. 2 and outputs the decoded prediction coefficients to the prediction decoding unit 35. In addition, the spatial information decoding unit 33 decodes the MPS code to obtain the similarity $ICC_i(k)$ using the example of the quantization table for the similarity value illustrated in FIG. 3 and outputs the decoded similarity to the matrix conversion unit 36. Furthermore, the spatial information decoding unit 33 decodes the MPS code to obtain the intensity difference $CLD_j(k)$ using the example of the quantization table for an intensity difference illustrated in FIG. 4 and outputs the decoded intensity difference to the matrix conversion unit 36.

The AAC decoding unit 38 receives the AAC code from the demultiplexer 31 and decodes a low frequency component of the signal of each of the channels using the AAC decoding technique. Thereafter, the AAC decoding unit 38 outputs the decoded low frequency component to the time-frequency transform unit 39. Note that as the AAC decoding technique, the technique described in ISO/IEC 13818-7 may be employed, for example.

The time-frequency transform unit 39 converts the signal of each of the channels, that is, the time signal decoded by the AAC decoding unit 38, into a frequency signal using the QMF filter bank described in ISO/IEC14496-3, for example. Thereafter, the time-frequency transform unit 39 outputs the frequency signal to the SBR decoding unit 40. Alternatively, the time-frequency transform unit 39 may perform time-frequency transform using the following complex QMF filter bank:

$$QMF(k, n) = \exp\left(j\frac{\pi}{128}(k + 0.5)(2n + 1)\right), \quad 0 \le k < 64,\ 0 \le n < 128 \qquad \text{(Expression 13)}$$

where QMF(k, n) represents a complex QMF having a time n and a frequency k as the variables.

The SBR decoding unit 40 decodes the high frequency component of the signal of each of the channel using an SBR decoding technique. Note that as the SBR decoding technique, the technique described in ISO/IEC14496-3 may be employed, for example.

The channel signal decoding unit 32 outputs, to the prediction decoding unit 35, the left-side frequency signal $L_0(k, n)$ and the right-side frequency signal $R_0(k, n)$, which serve as the stereo frequency signals of the channels and which are decoded by the AAC decoding unit 38 and the SBR decoding unit 40. Note that the left-side frequency signal $L_0(k, n)$ and the right-side frequency signal $R_0(k, n)$ may be referred to as a "first channel signal" and a "second channel signal", respectively.

The residual signal decoding unit 34 receives the residual code from the demultiplexer 31. Thereafter, the residual signal decoding unit 34 outputs, to the prediction decoding unit 35, the residual signal res(k, n) obtained by decoding the residual code. For convenience of description, according to the first exemplary embodiment, the residual signal res(k, n) is included only the first frequency range and not in the second frequency range.

Through prediction decoding, the prediction decoding unit 35 obtains the center-channel signal $C_0(k, n)$ from the prediction coefficients $c_1(k)$ and $c_2(k)$ received from the spatial information decoding unit 33 and the stereo frequency signals received from the channel signal decoding unit 32, that is, the left-side frequency signal $L_0(k, n)$ and the right-side frequency signal $R_0(k, n)$. For example, the prediction decoding unit 35 may compute a prediction-decoded center-channel signal $C'_0(k, n)$ from the stereo frequency signal (the left-side frequency signal $L_0(k, n)$ and the right-side frequency signal $R_0(k, n)$) and the prediction coefficients $c_1(k)$ and $c_2(k)$ as follows:

$$C'_0(k,n)=c_1(k)\cdot L_0(k,n)+c_2(k)\cdot R_0(k,n) \quad \text{(Expression 14)}$$

Note that as may be seen from (Expression 9) and (Expression 14), the prediction-decoded center-channel signal $C'_0(k, n)$ is equivalent to the prediction-encoded center-channel signal $C'_0(k, n)$.

In addition, in the first frequency range in which the residual signal is received from the residual signal decoding unit 34, the prediction decoding unit 35 may obtain a residual corrected center-channel signal $C''_0(k, n)$ through prediction decoding using the residual signal res(k, n) defined by (Expression 11) as follows:

$$C''_0(k,n)=C'_0(k,n)+\mathrm{res}(k,n) \quad \text{(Expression 15)}$$

Note that the residual corrected center-channel signal $C''_0(k, n)$ is also referred to as a "corrected third channel signal". In addition, the residual corrected center-channel signal $C''_0(k, n)$ corrected using the residual signal res(k, n) may be expressed by using a real part and an imaginary part as follows:

$$C''_0(k,n)=C_{0\,Re}(k,n)+C_{0\,Im}(k,n)$$

$$C_{0\,Re}(k,n)=C'_{0\,Re}(k,n)+\mathrm{res}_{Re}(k,n)$$

$$C_{0\,Im}(k,n)=C'_{0\,Im}(k,n)+\mathrm{res}_{Im}(k,n) \quad \text{(Expression 16)}$$

where $\mathrm{res}_{Re}$ represents the real part of the residual signal, and $\mathrm{res}_{im}$ represents the imaginary part of the residual signal.

As described above, in the first frequency range including the residual signal res(k, n), the prediction decoding unit 35 may obtain, through prediction decoding, the center-channel signal $C_0(k, n)$ prior to prediction encoding without any error if the residual signal res(k, n) is not lost in quantization at the time of encoding. In contrast, in the second frequency range that does not include the residual signal res(k, n), the center-channel signal $C_0(k, n)$ is to be obtained through prediction decoding using only the stereo frequency signals and the prediction coefficients $c_1(k)$ and $c_2(k)$. As illustrated in the example of the quantization table for a prediction coefficient in FIG. 2, the number of coefficients that may be selected as the prediction coefficients $c_1(k)$ and $c_2(k)$ is small and, in addition, the range of the value of the coefficient is small. Accordingly, in prediction encoding, it is sometimes difficult to sufficiently reduce the error d(k) defined in (Expression 9). Therefore, in the second frequency range, the decoding error is larger than in the first frequency range. However, it is not practical that the residual signal res(k, n) is used even in the second frequency range, since a sufficient coding efficiency is not guaranteed.

Figure 8:
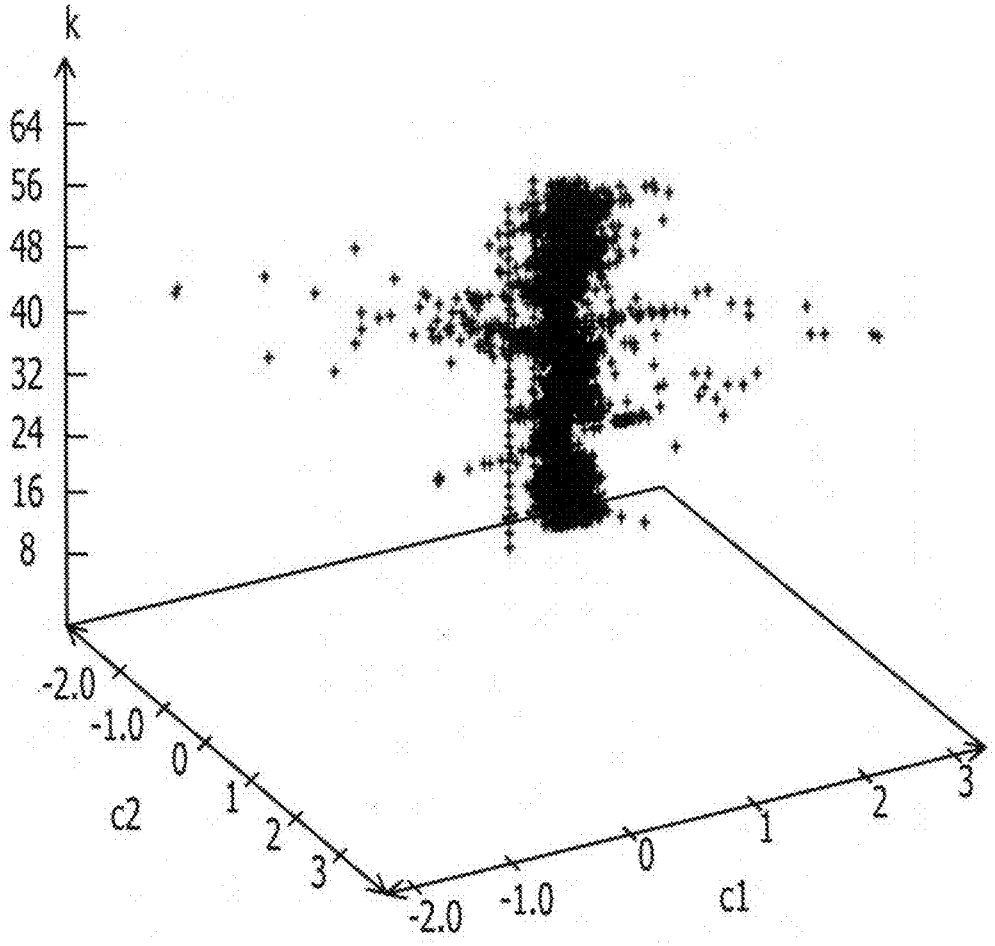
FIG. 8 is a correlation diagram between a frequency range and a prediction coefficient.

The present inventors have discovered new knowledge about the prediction coefficients $c_1(k)$ and $c_2(k)$ and the frequency range. FIG. 8 is a correlation diagram between the frequency range and each of the prediction coefficients $c_1(k)$ and $c_2(k)$. In FIG. 8, the prediction coefficients $c_1(k)$ and $c_2(k)$ indicate the prediction coefficients illustrated in FIG. 2. The frequency range k indicates each of ranges obtained by dividing the frequency range appearing in (Expression 1) into any ranges. As the number k increases, the frequency range becomes higher. As illustrated in FIG. 8, in the low-frequency range and the high-frequency range, the prediction coefficients $c_1(k)$ are close to each other, and the prediction coefficients $c_2(k)$ are closer to each other.

The reason for this is discussed below. First, it is widely known that like the above-described SBR, there is a correlation between the low-frequency range and the high-frequency range of an audio signal. Prediction-encoding expresses a relationship among $L_0$, $R_0$, and $C_0$ using the vector decomposition equation in (Expression 9). Since $L_0$, $R_0$, and $C_0$ are audio signals, there is a correlation between the low-frequency range and the high-frequency range thereof. From (Expression 9), the expression for prediction-encoding of a low-frequency range $C_{0Low}$ is expressed as follows: $C_{0Low}=\mathbf{c1}_{Low}\cdot L_{0Low}+\mathbf{c2}_{Low}\cdot R_{0Low}$, and the expression for prediction-encoding of a high-frequency range $C_{0high}$ is expressed as follows: $C_{0High}=\mathbf{c1}_{High}\cdot L_{0High}+\mathbf{c2}_{High}\cdot R_{0High}$. Then, in general, the high-frequency range has power attenuation more than the low-frequency range. Accordingly, assume that the attenuation of the high-frequency range is k times the attenuation of the low-frequency range. Then, the following expression may be obtained: $C_{0High}=k\cdot\mathbf{c1}_{Low}\cdot L_{0Low}+k\cdot\mathbf{c2}_{Low}\cdot R_{0Low}$. Thus, $\mathbf{c1}_{Low}=\mathbf{c1}_{High}$, and $\mathbf{c2}_{Low}=\mathbf{c2}_{High}$. That is, in the low-frequency range and the high-frequency range, the prediction coefficients $c_1(k)$ are close to each other, and the prediction coefficients $c_2(k)$ are close to each other. Conversely, when, in the low-frequency range and the high-frequency range, the prediction coefficients $c_1(k)$ are close to each other and if the prediction coefficients $c_2(k)$ are close to each other, there is a correlation between the low-frequency range and the high-frequency range of an audio signal.

By using such a phenomenon, even in the second frequency range in which the residual signal res(k, n) is not included, the prediction decoding unit 35 may obtain the center-channel signal $C_0(k, n)$ prior to prediction encoding by prediction decoding. At that time, the center-channel signal $C_0(k, n)$ has a sound quality that is the same as the sound quality obtained when the residual signal res(k, n) is used. This operation is described in detail below. FIG. 9A illustrates an example of a first data table stored in the prediction decoding unit 35. FIG.

9B illustrates an example of a second data table including corrected prediction coefficients $c'_1(k)$ and $c'_2(k)$ computed by the computing unit 41. Note that the first data table and the second data table are stored in, for example, memories (not illustrated) of the prediction decoding unit 35 and the computing unit 41.

As illustrated in FIG. 9A, a first data table 901 has a structure including the prediction coefficients $c_1(k)$ and $c_2(k)$ received from the spatial information decoding unit 33, the stereo frequency signal received from the channel signal decoding unit 32, and the residual signal res(k, n) received from the residual signal decoding unit 34 for each of the frequency ranges ($k_1$ to $k_8$). Note that if (Expression 1) or (Expression 13) is used, the number of the frequency ranges illustrated in FIGS. 9A and 9B is 64 (64 divided ranges). However, for convenience of description, the number of the frequency ranges is set to 8 (that is, $k_1$ to $k_8$). At that time, the frequency range $k_1$ is the lowest frequency range, and the frequency range $k_8$ is the highest frequency range. In addition, in the example illustrated in FIG. 9A, since the frequency ranges $k_1$ to $k_4$ include the residual signals (res($k_1$, n) to res($k_4$, n)), the frequency ranges $k_1$ to $k_4$ correspond to the above-described first frequency range. In addition, since each of the frequency ranges $k_5$ to $k_8$ does not include a residual signal (that is, the "residual signal" entries are all Null), the frequency ranges $k_5$ to $k_8$ correspond to the above-described second frequency range. However, the frequency ranges $k_1$ to $k_4$ may be defined as the second frequency range, and the frequency ranges $k_5$ to $k_8$ may be defined as the first frequency range.

The prediction decoding unit 35 refers to the first data table 901. In the frequency ranges $k_1$ to $k_4$ corresponding to the first frequency range that includes the residual signal res(k, n), the prediction decoding unit 35 obtains a residual correction center channel signal $C''_0(k, n)$ through prediction decoding using (Expression 14) and (Expression 15). Thereafter, the prediction decoding unit 35 determines whether a pair of the prediction coefficients $c_1(k)$ and $c_2(k)$ stored for the frequency ranges $k_5$ to $k_8$ corresponding to the second frequency range that does not include a residual signal match any pair of the prediction coefficients $c_1(k)$ and $c_2(k)$ stored for the frequency ranges $k_1$ to $k_4$. In the example illustrated in FIG. 9A, the pair of the prediction coefficients $c_1(k)$ and $c_2(k)$ for the frequency range $k_6$ matches the pair for the frequency range $k_2$. Accordingly, a "correction determination" flag in the first data table 901 is set to "Yes". In addition, the frequency range "$k_2$" is set in the "correction source frequency range" entry. Note that in addition to frequency range $k_2$, if a pair of the prediction coefficients $c_1(k)$ and $c_2(k)$ for a frequency range other than the frequency range $k_2$ is matched, for example, if a pair of the prediction coefficients $c_1(k)$ and $c_2(k)$ for a frequency range $k_4$ is matched in addition to that for the frequency range $k_2$, the frequency range $k_4$ that is closer to the frequency range $k_6$ than the frequency range $k_2$ may be set in the "correction source frequency range" entry.

In addition, if the prediction coefficients $c_1(k)$ and $c_2(k)$ set in frequency ranges $k_{B5}$ to $K_{B8}$ corresponding to the second frequency range are within a predetermined threshold value from the prediction coefficients $c_1(k)$ and $c_2(k)$ set in frequency ranges $k_{B1}$ to $K_{B4}$, the prediction decoding unit 35 may set the "correction determination" flag to "Yes". At that time, the predetermined threshold value may be appropriately determined by, for example, referring to the values of the quantization table illustrated in FIG. 2. Furthermore, prediction-decoding (described below) may be performed on the determined threshold value. Thereafter, a range in which the sound quality is improved may be obtained through subjective appraisal or simulation evaluation, and the threshold value may be adjusted. If the predetermined threshold value is determined to be ±0.2 for the first data table 901, each of the prediction coefficients $c_1(k)$ and $c_2(k)$ for each of the frequency ranges $k_8$ and $k_4$ is within the threshold value. In such a case, the prediction decoding unit 35 sets the "correction determination" flag to "Yes" and sets the frequency range "$k_{B4}$" in the "correction source frequency range" entry of the first data table 901.

The computing unit 41 included in the prediction decoding unit 35 illustrated in FIG. 2 refers to the first data table 901 illustrated in FIG. 9A and acquires the frequency range stored in the correction source frequency entry. In the example illustrated in FIG. 9A, the entry of "correction determination" for a frequency range $k_6$ is set to "Yes". Thus, $k_2$ is referred to as a correction source frequency range. At that time, in the frequency range $k_{B2}$, the computing unit 41 computes correction prediction coefficients $c'_1(k)$ and $c'_2(k)$ from the residual correction center channel signal $C''_0(k, n)$ obtained through correction using the residual signal res(k, n) expressed by (Expression 15) as follows:

$$C''_0(k,n)=c'_1(k)\cdot L_0(k,n)+c'_2(k)\cdot R_0(k,n) \quad \text{(Expression 17)}$$

Note that the prediction coefficients $c_1(k)$ and $c_2(k)$ of the first frequency range including a residual signal may be referred to as a "first prediction coefficient", the prediction coefficients $c_1(k)$ and $c_2(k)$ of the second frequency range not including a residual signal may be referred to as a "second prediction coefficient, and the correction prediction coefficients $c'_1(k)$ and $c'_2(k)$ may be referred to as a "second correction prediction coefficient".

When computing the correction prediction coefficients $c'_1(k)$ and $c'_2(k)$ in (Expression 17), the computing unit 41 may compute any values that minimize an error in prediction decoding as the correction prediction coefficients $c'_1(k)$ and $c'_2(k)$ without limitation of the value and the range of the prediction coefficient stored in the example of the quantization table for the prediction coefficient illustrated in FIG. 2. As a technique for computing the correction prediction coefficients $c'_1(k)$ and $c'_2(k)$ that minimize an error in prediction decoding, the technique described in Non-patent literature KISHI yohei et al., "Method for improving sound quality in MPEG surround encoding by prediction parameter selection based on prediction error distribution", Reports of the 2012 spring meeting of the Acoustical Society of Japan, Mar. 6, 2012, may be employed. Note that in this technique, if the shape of the distribution, that is, the shape of error distribution, is elliptical (an elliptic paraboloid surface), the least squares solution serves as the correction prediction coefficients $c'_1(k)$ and $c'_2(k)$. If the shape of error distribution is parabolic (a parabolic cylinder surface), any points on the straight line that minimizes an error may be the correction prediction coefficients $c'_1(k)$ and $c'_2(k)$. In addition, in this technique, the positional relationship between the error minimal solution and the code book range is not to be taken into account in prediction decoding.

The computing unit 41 stores the computed correction prediction coefficients $c'_1(k)$ and $c'_2(k)$ for the frequency range $k_2$ in the correction prediction coefficient entry of a second data table 902 (illustrated in FIG. 9B) for the frequency range $k_2$ and, additionally, the correction prediction coefficient entry of the second data table 902 for the frequency range $k_6$. For the frequency range $k_6$, the prediction decoding unit 35 computes a replacement correction center channel signal $C'''_0(k, n)$ prediction-decoded for the frequency range $k_6$ by using the correction prediction coefficients $c'_1(k)$ and $c'_2(k)$ stored in the correction prediction coefficient entry of the second data table 902 as follows:

$$C'''_0(k,n)=c'_1(k)\cdot L_0(k,n)+c'_2(k)\cdot R_0(k,n) \quad \text{(Expression 18)}$$

The technical benefit of the operation is described below. An error in the residual correction center channel signal $C''_0(k, n)$ has already been corrected by using the residual signal res(k, n) expressed by (Expression 15). Accordingly, the sound quality of the residual correction center channel signal $C''_0(k, n)$ is basically the same as that of the center-channel signal $C_0(k, n)$. By using the correction prediction coefficients $c'_1(k)$ and $c'_2(k)$ computed without limitation of the value and the range of the prediction coefficient stored in the example of the quantization table for a prediction coefficient illustrated in FIG. 2, the residual correction center channel signal $C''_0(k, n)$ may be losslessly and completely reconstructed. Therefore, the sound quality is the same as that of the center-channel signal $C_0(k, n)$ prior to prediction encoding. This may be also seen from a comparison of (Expression 15) and (Expression 18).

That is, the correction prediction coefficients $c'_1(k)$ and $c'_2(k)$ are replacements of the residual signal res(k, n) as parameters of another dimension. In such a case, as illustrated in FIG. 8, when the prediction coefficients $c_1(k)$ in the low frequency range and the high frequency range are close to each other and if the prediction coefficients $c_2(k)$ in the low frequency range and the high frequency range are close to each other, there is a correlation between the low-frequency range and the high-frequency range of an audio signal. Accordingly, for two frequency ranges in which the prediction coefficients $c_1(k)$ are close to each other and the prediction coefficients $c_2(k)$ are close to each other, by obtaining a center channel signal through prediction decoding using the correction prediction coefficients $c'_1(k)$ and $c'_2(k)$, the advantage that is the same as that obtained through prediction decoding using the residual signal res(k, n) may be obtained. Through such a technical benefit, an error occurring in encoding may be virtually corrected even for the frequency range that does not include the residual signal res(k, n). As a result, the sound quality after prediction decoding may be improved.

Note that the prediction decoding unit 35 computes the prediction-decoded center-channel signal $C'_0(k, n)$ for the frequency range having "correction determination" of "No" in the first data table 901 illustrated in FIG. 9A using (Expression 14). Thereafter, the prediction decoding unit 35 outputs, to the matrix conversion unit 36 illustrated in FIG. 2, one of the prediction-decoded center-channel signal $C'_0(k, n)$ obtained through prediction decoding, the residual correction center channel signal $C''_0(k, n)$, and the replacement correction center channel signal $C'''_0(k, n)$ for each of the frequency ranges and the stereo frequency signal.

The matrix conversion unit 36 performs matrix conversion on the left-side frequency signal $L_0(k, n)$, the right-side frequency signal $R_0(k, n)$, and the center-channel signal $C_0(k, n)$ (one of the prediction-decoded center-channel signal $C'_0(k, n)$, the residual correction center channel signal $C''_0(k, n)$, and the replacement correction center channel signal $C'''_0(k, n)$) received from the prediction decoding unit 35 as follows:

$$\begin{pmatrix} L_{out}(k,n) \\ R_{out}(k,n) \\ C_{out}(k,n) \end{pmatrix} = \frac{1}{3}\begin{pmatrix} 2 & -1 & 1 \\ -1 & 2 & 1 \\ \sqrt{2} & \sqrt{2} & -\sqrt{2} \end{pmatrix}\begin{pmatrix} L_0(k,n) \\ R_0(k,n) \\ C_0(k,n) \end{pmatrix} \quad \text{(Expression 19)}$$

where $L_{out}(k, n)$, $R_{out}(k, n)$, and $C_{out}(k, n)$ are the frequency signals of the left channel, the right channel, and the center channel, respectively. In addition, if (Expression 19) is expressed as a signal using a real part and an imaginary part, (Expression 19) is rewritten as follows:

$$\begin{pmatrix} L_{out}(k,n) \\ R_{out}(k,n) \\ C_{out}(k,n) \end{pmatrix} = \begin{pmatrix} L_{out\ Re}(k,n) \\ R_{out\ Re}(k,n) \\ C_{out\ Re}(k,n) \end{pmatrix} + \begin{pmatrix} L_{out\ Im}(k,n) \\ R_{out\ Im}(k,n) \\ C_{out\ Im}(k,n) \end{pmatrix} \quad \text{(Expression 20)}$$

$$\begin{pmatrix} L_{out\ Re}(k,n) \\ R_{out\ Re}(k,n) \\ C_{out\ Re}(k,n) \end{pmatrix} = \frac{1}{3}\begin{pmatrix} 2 & -1 & 1 \\ -1 & 2 & 1 \\ \sqrt{2} & \sqrt{2} & -\sqrt{2} \end{pmatrix}\begin{pmatrix} L_{0Re}(k,n) \\ R_{0Re}(k,n) \\ C_{0Re}(k,n) \end{pmatrix}$$

$$\begin{pmatrix} L_{out\ Im}(k,n) \\ R_{out\ Im}(k,n) \\ C_{out\ Im}(k,n) \end{pmatrix} = \frac{1}{3}\begin{pmatrix} 2 & -1 & 1 \\ -1 & 2 & 1 \\ \sqrt{2} & \sqrt{2} & -\sqrt{2} \end{pmatrix}\begin{pmatrix} L_{0Im}(k,n) \\ R_{0Im}(k,n) \\ C_{0Im}(k,n) \end{pmatrix}$$

The matrix conversion unit 36 performs an upmix process using the spatial information (the similarity $ICC_i(k)$ and the intensity difference $CLD_j(k)$) received from the spatial information decoding unit 33 and generates a 5.1 ch audio signal. The upmix process may be performed using, for example, the technique described in ISO/IEC23003-1.

The frequency-time transform unit 37 converts each of the signals received from the matrix conversion unit 36 from a frequency signal format to a time signal format using the following QMF filter bank:

$$IQMF(k,n) = \frac{1}{64}\exp\left(j\frac{\pi}{64}\left(k+\frac{1}{2}\right)(2n-127)\right), \quad 0 \le k < 32,\ 0 \le n < 32 \quad \text{(Expression 21)}$$

Figure 10A:
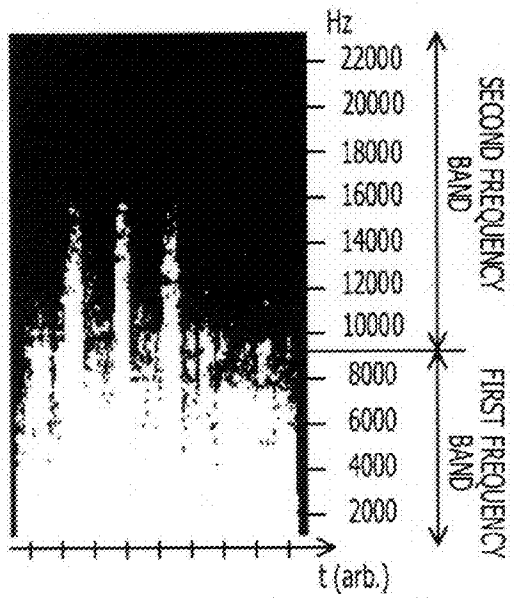
FIG. 10A is a spectrum diagram of the original sound of the audio signal of a multichannel.
Figure 10B:
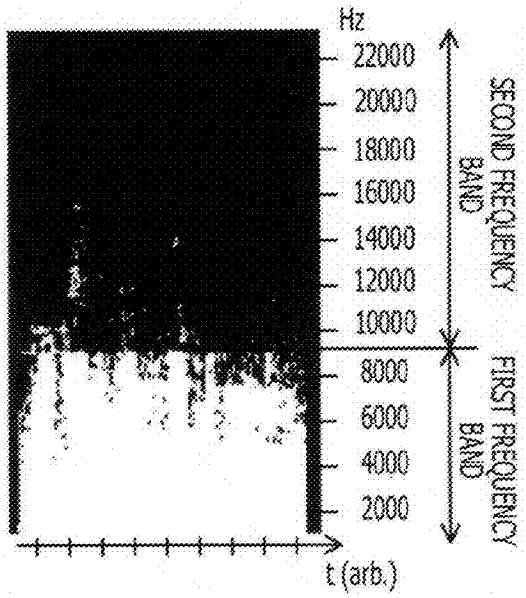
FIG. 10B is a spectrum diagram of an audio signal subjected to prediction decoding according to a comparative example.
Figure 10C:
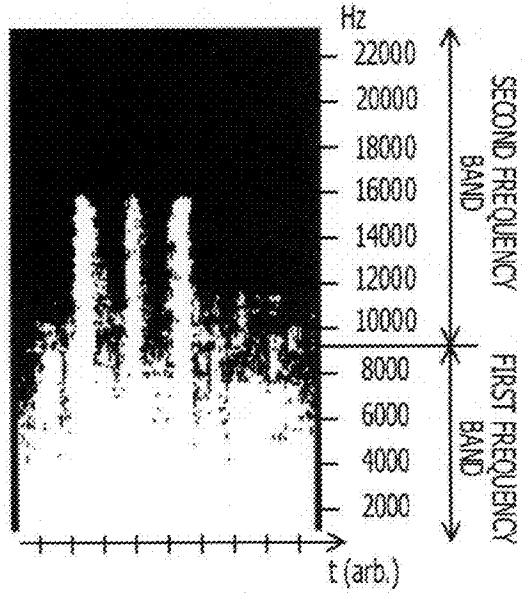
FIG. 10C is a spectrum diagram of an audio signal subjected to prediction decoding according to a first exemplary embodiment.

FIG. 10A is a spectrum diagram of the original sound of a multichannel audio signal. FIG. 10B is a spectrum diagram of an audio signal subjected to prediction decoding according to a comparative example. FIG. 10C is a spectrum diagram of an audio signal subjected to prediction decoding according to the first exemplary embodiment. The ordinate of the spectrum diagram in each of FIGS. 10A to 10C represents a frequency, and the abscissa represents a sampling time. Note that in FIG. 10B, as a comparative example, in the first frequency range that includes the residual signal res(k, n), a correction process is performed using the residual signal res(k, n) after prediction decoding. In addition, in the second frequency range that does not include the residual signal res(k, n), prediction decoding is performed using only the prediction coefficients and the stereo frequency signal. As may be seen from a comparison of FIG. 10A and FIG. 10C, in the prediction decoding of the comparative example, in the second frequency range that does not include the residual signal res(k, n), the audio signal is not normally decoded. Accordingly, a degradation in the sound quality is observed. In contrast, in the prediction decoding according to the first exemplary embodiment, even in the second frequency range that does not include the residual signal res(k, n), an audio signal having a spectrum that is substantially the same as that of the original sound is reproduced.

As described above, in the audio decoding device according to the first exemplary embodiment, an error occurring in encoding for the frequency range not including a residual signal may be virtually corrected. Thus, the sound quality after prediction decoding may be improved.

Figure 11:
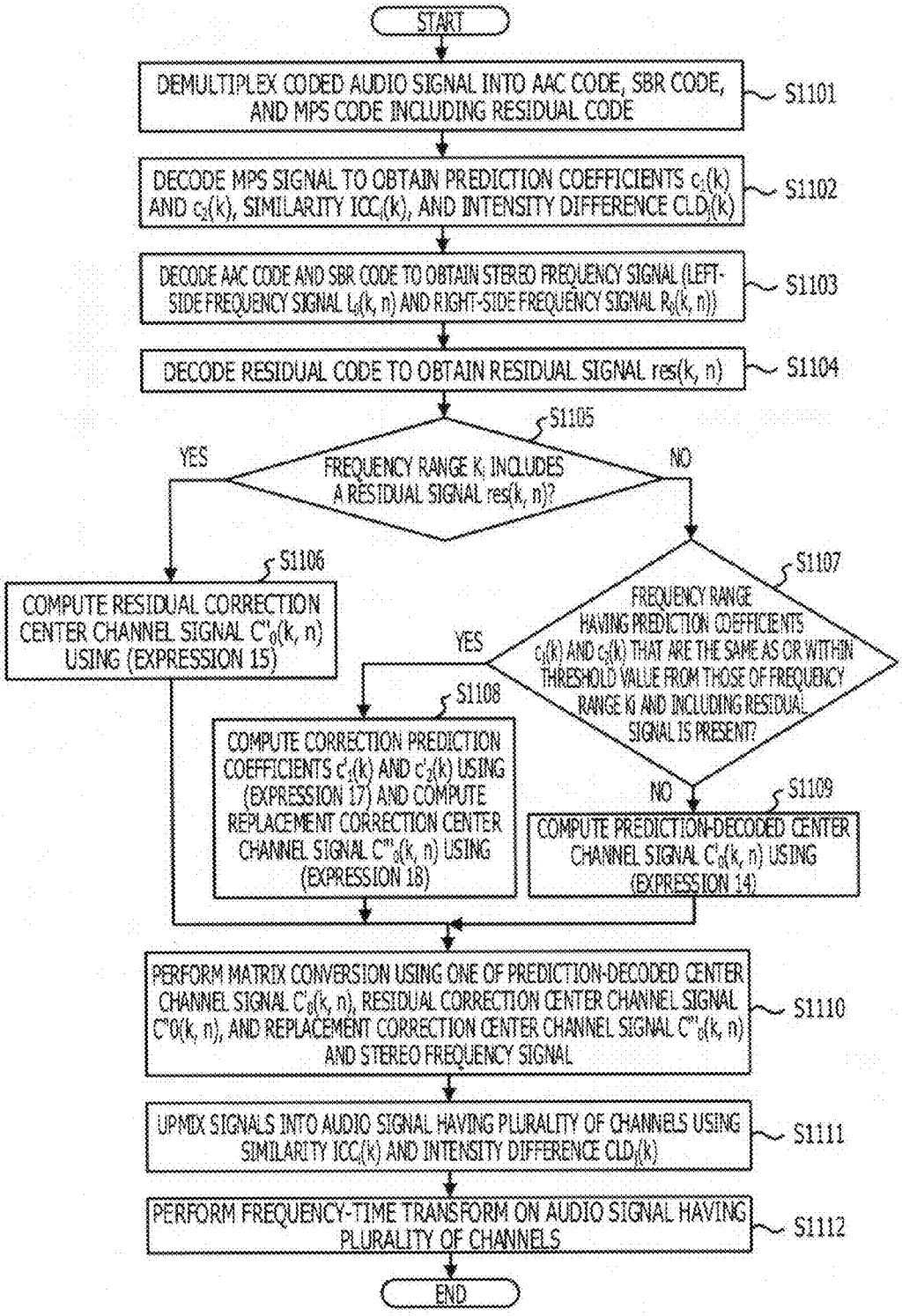
FIG. 11 is a flowchart of the audio decoding process.

FIG. 11 is a flowchart of the audio decoding process. Note that the flowchart illustrated in FIG. 11 describes the process performed on a multichannel audio signal for one frame. While receiving an encoded multichannel audio signal, the audio decoding device 2 repeatedly performs the audio decoding process illustrated in FIG. 11 for all of the frequency ranges of each of the frames.

The demultiplexer 31 receives a coded audio signal from the outside and demultiplexes the coded audio signal into encoded AAC code and SBR code and an MPS code including the residual code (step S1101).

The spatial information decoding unit 33 receives the MPS code other than the residual code from the demultiplexer 31. Thereafter, the spatial information decoding unit 33 decodes the MPS code into the prediction coefficients $c_1(k)$ and $c_2(k)$ using the example of the quantization table for prediction coefficients illustrated in FIG. 2. The spatial information decoding unit 33 outputs the prediction coefficients $c_1(k)$ and $c_2(k)$ to the prediction decoding unit 35. In addition, the spatial information decoding unit 33 decodes the MPS code into the similarity $ICC_i(k)$ using the example of the quantization table for similarity illustrated in FIG. 3. Thereafter, the spatial information decoding unit 33 outputs the similarity $ICC_i(k)$ to the matrix conversion unit 36. Furthermore, the spatial information decoding unit 33 decodes the MPS code into the intensity difference $CLD_j(k)$ using the example of the quantization table for intensity differences illustrated in FIG. 4. Thereafter, the spatial information decoding unit 33 outputs the intensity difference $CLD_j(k)$ to the matrix conversion unit 36 (step S1102).

The AAC decoding unit 38 receives the AAC code from the demultiplexer 31 and decodes the AAC code into the low frequency component of a signal of each of the channels using an AAC decoding technique. Thereafter, the AAC decoding unit 38 outputs the low frequency component to the time-frequency transform unit 39. The time-frequency transform unit 39 converts the signal of each of the channels, which is a time signal decoded by the AAC decoding unit 38, into a frequency signal and outputs the frequency signal to the SBR decoding unit 40. The SBR decoding unit 40 obtains the high frequency component of the signal of each of the channels through decoding using an SBR decoding technique. The channel signal decoding unit 32 outputs the left-side frequency signal $L_0(k, n)$ and the right-side frequency signal $R_0(k, n)$ to the prediction decoding unit 35 (step S1103). Note that the left-side frequency signal $L_0(k, n)$ and the right-side frequency signal $R_0(k, n)$ are the stereo frequency signals of the channels decoded by the AAC decoding unit 38 and the SBR decoding unit 40.

The residual signal decoding unit 34 receives the residual code from the demultiplexer 31. Thereafter, the residual signal decoding unit 34 outputs, to the prediction decoding unit 35, the residual signal res(k, n) obtained by decoding the residual code (step S1104).

The prediction decoding unit 35 determines whether the frequency range $K_i$ includes a residual signal $res(k_i, n)$ by referring to the first data table 901 illustrated in FIG. 9A (step S1105).

If the frequency ranges includes the residual signal $res(k_i, n)$ (Yes in step S1105), the prediction decoding unit 35 computes the residual correction center channel signal $C''_0(k, n)$ using (Expression 15) (step S1106).

However, if the frequency ranges $K_i$ does not include the residual signal $res(k_i, n)$ (No in step S1105), the prediction decoding unit 35 refers to the first data table 901 illustrated in FIG. 9A, for example. Thereafter, the prediction decoding unit 35 determines whether a frequency range having the prediction coefficients $c_1(k)$ and $c_2(k)$ that are the same as or within a threshold value from those of the frequency range $K_i$ and including a residual signal is present (step S1107).

If a frequency range having the prediction coefficients $c_1(k)$ and $c_2(k)$ that are the same as or within the threshold value from those of the frequency range $K_i$ and including a residual signal is present (Yes in step S1107), the computing unit 41 computes correction prediction coefficients $c'_1(k)$ and $c'_2(k)$ using (Expression 17). In addition, the computing unit 41 computes the replacement correction center channel signal $C'''_0(k, n)$ using (Expression 18) (step S1108).

However, if a frequency range having the prediction coefficients $c_1(k)$ and $c_2(k)$ that are the same as or within the threshold value from those of the frequency range $K_i$ and including a residual signal is not present (No in step S1107), the prediction decoding unit 35 computes the prediction-decoded center-channel signal $C'_0(k, n)$ using (Expression 18) (step S1109). Note that the prediction decoding unit 35 outputs, to the matrix conversion unit 36, one of the prediction-decoded center-channel signal $C'_0(k, n)$ obtained through prediction decoding, the residual correction center channel signal $C''_0(k, n)$, and the replacement correction center channel signal $C'''_0(k, n)$ and the stereo frequency signal for each of the frequency ranges.

The matrix conversion unit 36 performs matrix conversion using one of the prediction-decoded center-channel signal $C'_0(k, n)$, the residual correction center channel signal $C''_0(k, n)$, and the replacement correction center channel signal $C'''_0(k, n)$ and the stereo frequency signal (the left-side frequency signal $L_0(k, n)$ and the right-side frequency signal $R_0(k, n)$) received from the prediction decoding unit 35 (step S1110).

In addition, the matrix conversion unit 36 upmixes the signals into a multichannel audio signal (for example, a 5.1 ch audio signal) using the spatial information (the similarity $ICC_i(k)$ and the intensity difference $CLD_j(k)$) received from the spatial information decoding unit 33 (step S1111).

The frequency-time transform unit 37 converts each of the signals received from the matrix conversion unit 36 from a frequency signal format into a time signal format. Thereafter, the frequency-time transform unit 37 outputs the time signal to the outside (step S1112). Thus, the audio decoding device 2 completes the decoding process.

Note that the audio decoding device 2 may simultaneously perform the processes in steps S1102 and S1104. Alternatively, the audio decoding device 2 may perform either one of the processes in steps S1102 and S1104 first.

Figure 12:
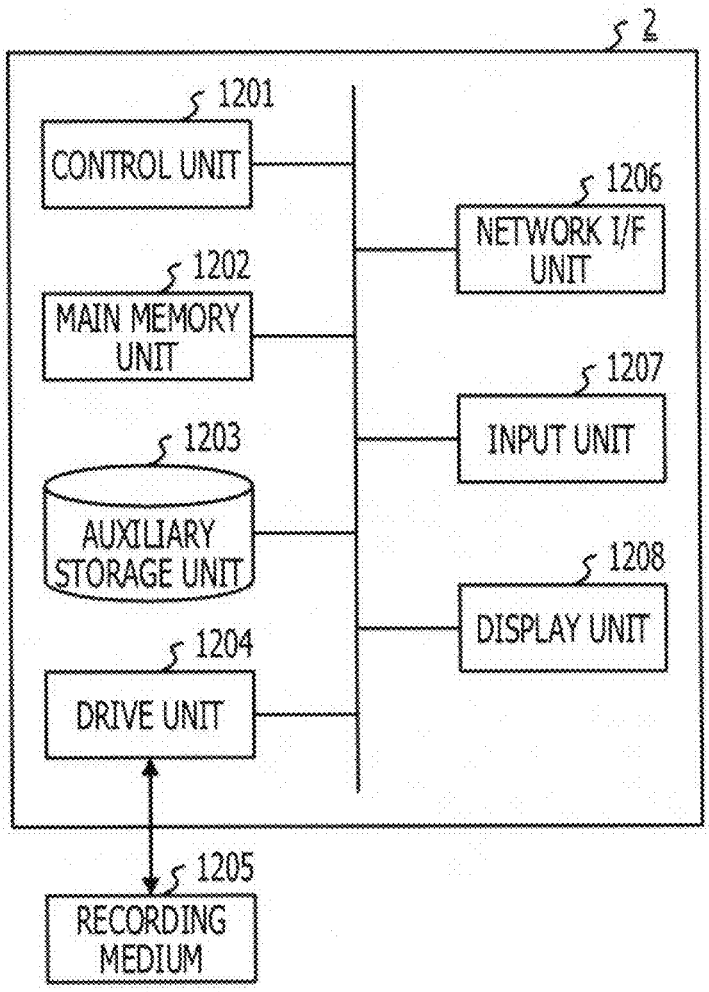
FIG. 12 is a hardware block diagram of an audio decoding device according to an exemplary embodiment.

FIG. 12 is a hardware block diagram of the audio decoding device 2 according to an exemplary embodiment. As illustrated in FIG. 12, the audio decoding device 2 includes a control unit 1201, a main memory unit 1202, an auxiliary storage unit 1203, a drive unit 1204, a network interface (I/F) unit 1206, an input unit 1207, and a display unit 1208. These units are connected to one another via a bus so as to communicate data with one another.

The control unit 1201 is a central processing unit (CPU) of a computer that controls the units, performs a calculation operation, and processes data. In addition, the control unit 1201 serves as a processor that executes the program stored in the main memory unit 1202 and the auxiliary storage unit 1203. The control unit 1201 receives data from the input unit 1207 and a storage unit, processes the data, and outputs the processed data to the display unit 1208 and the storage unit.

A read only memory (ROM) or a random access memory (RAM) is used as the main memory unit 1202. The main memory unit 1202 permanently or temporarily stores programs to be executed by the control unit 1201 and data. Examples of the programs include an operating system (OS), which is basic software, and application software.

For example, a hard disk drive (HDD) is used as the auxiliary storage unit 1203. The auxiliary storage unit 1203 stores data related to the application software.

The drive unit 1204 reads a program stored in a recording medium 1205, such as a flexible disk, and installs the program in the auxiliary storage unit 1203.

The recording medium 1205 further stores a predetermined program. The program stored in the recording medium 1205 is installed in the audio decoding device 2 via the drive unit 1204. The installed predetermined program may be executed by the audio decoding device 2.

The network I/F unit 1206 serves as an interface between the audio decoding device 2 and a peripheral device having a communication function and being connected to the audio decoding device 2 via a network, such as a local area network (LAN) or a wide area network (WAN). The network is constructed in a wired and/or wireless data transmission line.

The input unit 1207 includes a keyboard having a cursor key, a number key, and a variety of function keys, and a mouse or slide pad for selecting a key in a display screen of the display unit 1208. In addition, the input unit 1207 serves as a user interface for a user to input an instruction and data to the control unit 1201.

The display unit 1208 includes, but not limited to, a cathode ray tube (CRT) or a liquid crystal display (LCD), which displays data received from the control unit 1201.

Note that the above-described audio decoding process may be realized in the form of a computer program executed by a computer. By installing the program in, for example, a server and causing a computer to execute the program, the audio decoding process may be realized.

Alternatively, by recording the program in the recording medium 1205 and causing a computer or a mobile terminal to read the program recorded in the recording medium 1205, the above-described audio decoding process may be realized. A variety of types of recording medium may be used as the recording medium 1205. Examples of the recording medium 1205 include a recording medium that optically, electrically, or magnetically records information therein, such as a compact disk-read only memory (CD-ROM), a flexible disk, or a magnetooptic disk, and a semiconductor memory that electrically records information, such as a flash memory.

The hardware configuration of the audio encoding device 1 may be similar to the hardware configuration of the audio decoding device 2 illustrated in FIG. 12.

The computer program that causes a computer to realize the functions of the units of the audio decoding device may be stored in a recording medium, such as a semiconductor memory, a magnetic recording medium, or an optical recording medium, and may be distributed. In addition, the multichannel audio signal to be decoded is not limited to a 5.1 ch audio signal. For example, an audio signal to be decoded may be an audio signal having a plurality of channels, such as a 3 ch, 3.1 ch, or 7.1 ch audio signal.

In addition, the audio decoding device according to the above-described exemplary embodiment may be integrated into a variety of apparatuses used for transmitting, recording, or receiving an audio signal (for example, a computer, a video signal recorder, or a video transmission apparatus).

Second Exemplary Embodiment

Figure 13:
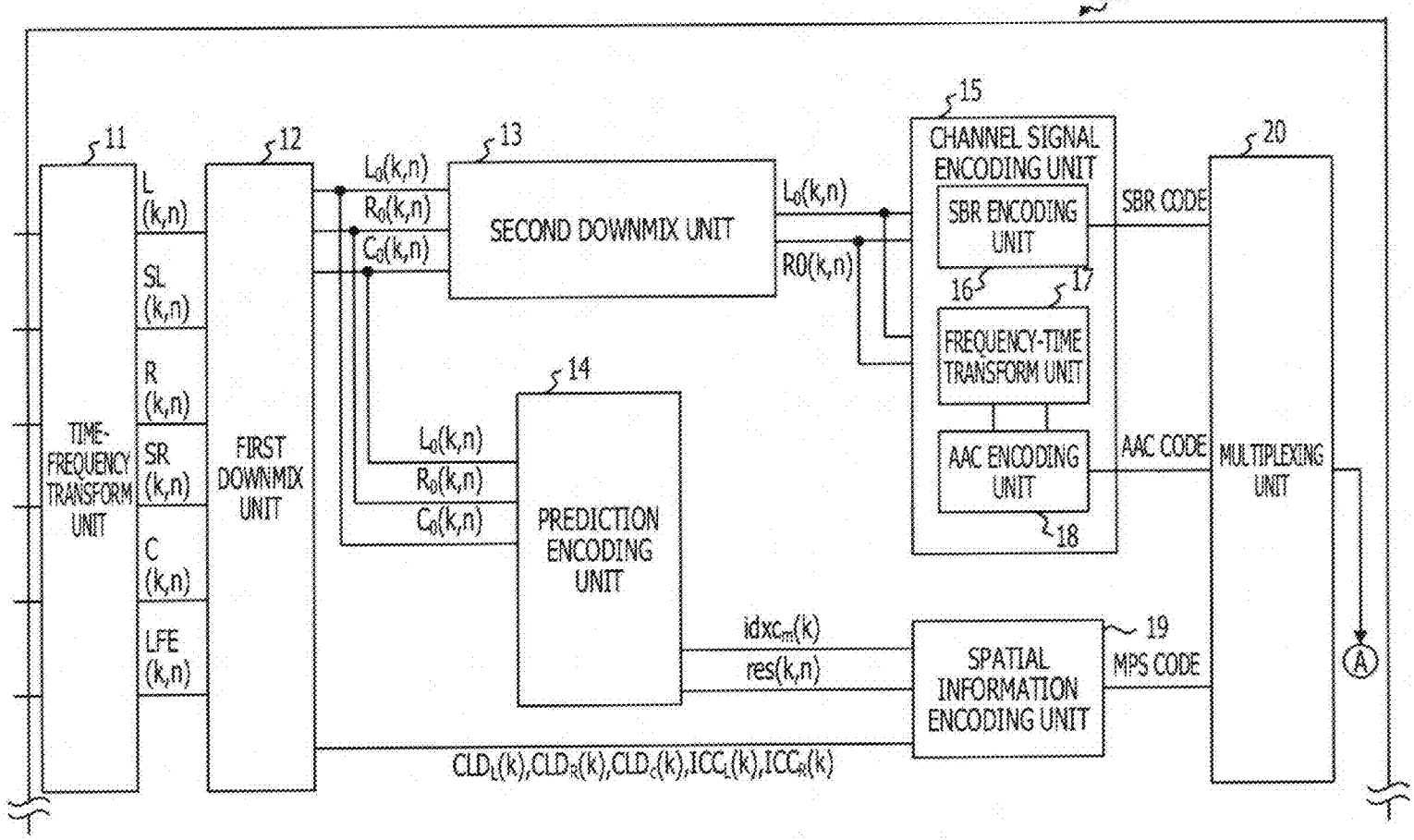
FIG. 13 is a first functional block of an audio encoding and decoding system according to an exemplary embodiment.
Figure 14:
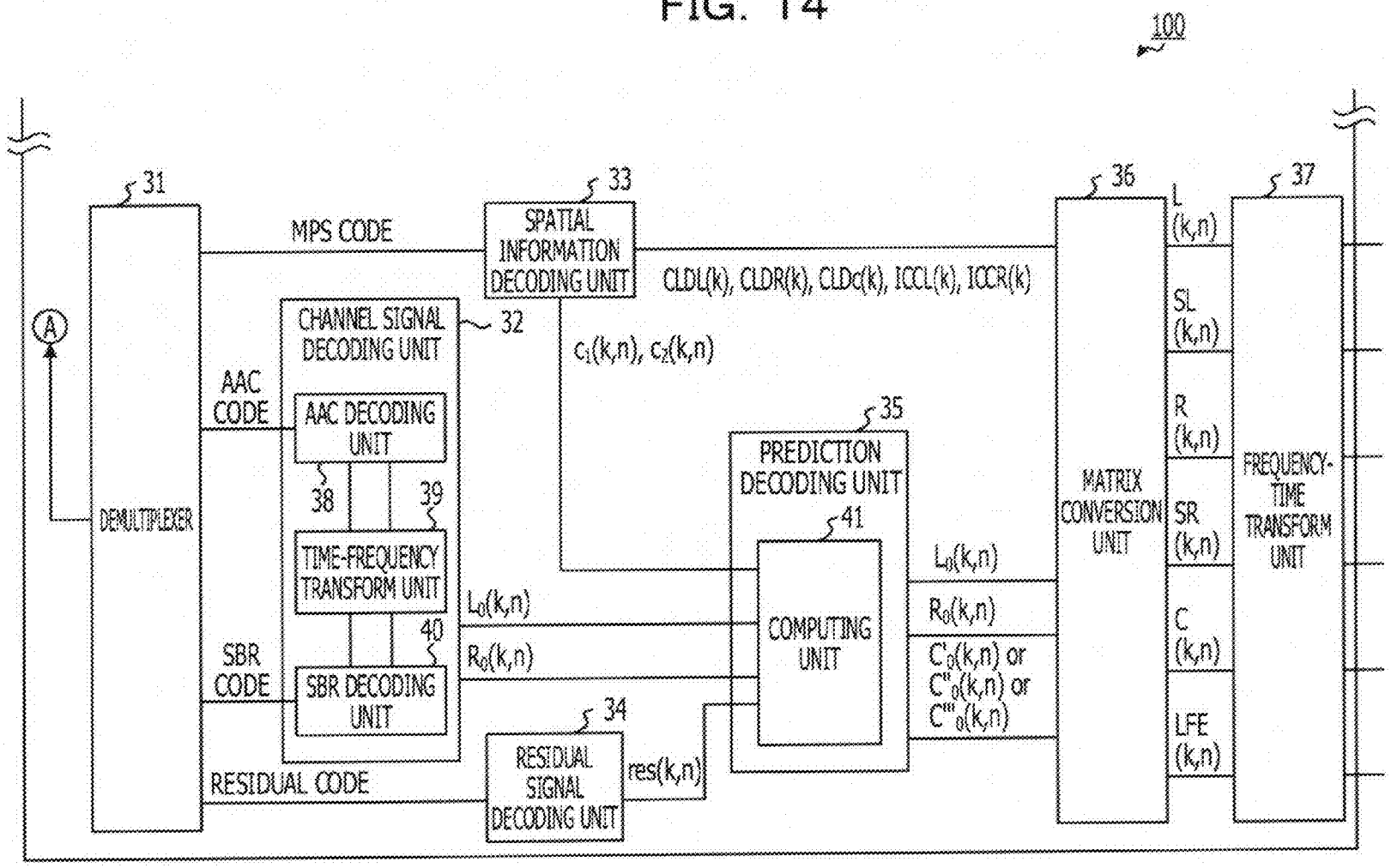
FIG. 14 is a second functional block diagram of the audio encoding and decoding system according to the exemplary embodiment.

FIG. 13 is a first functional block of an audio encoding and decoding system 100 according to a second exemplary embodiment. FIG. 14 is a second functional block diagram of the audio encoding and decoding system 100 according to the present exemplary embodiment. As illustrated in FIGS. 13 and 14, the audio encoding and decoding system 100 includes a time-frequency transform unit 11, a first downmix unit 12, a second downmix unit 13, a prediction encoding unit 14, a channel signal encoding unit 15, a spatial information encoding unit 19, and a multiplexing unit 20. The channel signal encoding unit 15 includes an SBR encoding unit 16, a frequency-time transform unit 17, and an AAC encoding unit 18. The audio encoding and decoding system 100 further includes a demultiplexer 31, a channel signal decoding unit 32, a spatial information decoding unit 33, a residual signal decoding unit 34, a prediction decoding unit 35, a matrix conversion unit 36, and a frequency-time transform unit 37. The channel signal decoding unit 32 includes an AAC decoding unit 38, a time-frequency transform unit 39, and an SBR decoding unit 40. The prediction decoding unit 35 includes a computing unit 41. Note that the functions of these units of the audio encoding and decoding system 100 are the same as those of the units illustrated in FIGS. 1 and 7. Accordingly, detailed descriptions of the units are not repeated.

Even in the audio encoding and decoding system according to the second exemplary embodiment, in a frequency range that does not include a residual signal, an error occurring in an encoding operation may be virtually corrected. As a result, the sound quality in prediction decoding may be improved.

Note that in the above-described exemplary embodiments, the physical configurations of the components of each of the devices may differ from those in the drawings. That is, distribution and integration of the devices are not limited to those in the drawings. All or some of the devices may be functionally or physically distributed or integrated into any structure in accordance with the processing load and the use conditions of the devices.

In another exemplary embodiment, the channel signal encoding unit of an audio encoding device may perform an encoding operation using another encoding technique. For example, the channel signal encoding unit may encode all of the frequency signals using the AAC coding technique. In such a case, the SBR encoding unit 16 illustrated in FIGS. 1 and 13 and the SBR decoding unit 40 illustrated in FIGS. 7 and 14 are removed.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An audio decoding device comprising:

a processor; and a memory which stores a plurality of instructions, which when executed by the processor, cause the processor to execute, decoding, using a first channel signal and a second channel signal included in a plurality of channels of an audio signal having a first frequency range and a second frequency range, a first prediction coefficient of the first frequency range and a second prediction coefficient of the second frequency range, both selected from a code book when prediction-encoding a third channel signal that is not subjected to prediction encoding and that is included in the plurality of channels;

decoding a residual signal included in the first frequency range, the residual signal representing an error occurring in prediction encoding; and prediction-decoding the third channel signal subjected to prediction-encoding in the second frequency range from the first channel signal, the second channel signal, the third channel signal subjected to prediction encoding, the first prediction coefficient, and the residual signal of the first frequency range and the first channel signal and the second channel signal of the second frequency range.

2. The device according to claim 1, further comprising:

computing a third prediction coefficient from the first channel signal, the second channel signal, and the third channel signal subjected to prediction encoding, the first prediction coefficient, and the residual signal of the first frequency range, wherein in the prediction-decoding, the prediction-encoded third channel signal of the second frequency range is obtained from the first channel signal and the second channel signal of the second frequency range and the third prediction coefficient.

3. The device according to claim 2, wherein in the computing, the third prediction coefficient is computed if each of the first prediction coefficient and the second prediction coefficient is within a predetermined threshold value.

4. The device according to claim 2, wherein in the computing, a corrected third channel signal is obtained by correcting the third channel signal subjected to prediction encoding using the residual signal, and wherein in the computing, the third prediction coefficient is obtained on the basis of a distribution computed using the first channel signal and the second channel signal of the first frequency range and the corrected third prediction coefficient.

5. The device according to claim 4, wherein the distribution is defined by a predetermined curved surface having a minimum value.

6. The device according to claim 5, wherein the predetermined curved surface is one of a parabolic cylinder surface and an elliptic paraboloid surface.

7. The device according to claim 1, wherein the prediction decoding includes prediction-decoding the third channel signal of the first frequency range subjected to the prediction encoding from the first channel signal and the second channel signal, the first prediction coefficient, and the residual signal of the first frequency range.

8. An audio decoding method comprising:

decoding, using a first channel signal and a second channel signal included in a plurality of channels of an audio signal having a first frequency range and a second frequency range, a first prediction coefficient of the first frequency range and a second prediction coefficient of the second frequency range, both selected from a code book when prediction-encoding a third channel signal that is not subjected to prediction encoding and that is included in the plurality of channels;

decoding, by a computer processor, a residual signal included in the first frequency range, the residual signal representing an error occurring in prediction encoding; and prediction-decoding the third channel signal subjected to prediction-encoding in the second frequency range from the first channel signal, the second channel signal, the third channel signal subjected to prediction encoding, the first prediction coefficient, and the residual signal of the first frequency range and the first channel signal and the second channel signal of the second frequency range.

9. The method according to claim 8, further comprising:

computing a third prediction coefficient from the first channel signal, the second channel signal, and the third channel signal subjected to prediction encoding, the first prediction coefficient, and the residual signal of the first frequency range, wherein in the prediction-decoding, the prediction-encoded third channel signal of the second frequency range is obtained from the first channel signal and the second channel signal of the second frequency range and the third prediction coefficient.

10. The method according to claim 9, wherein in the computing, the third prediction coefficient is computed if each of the first prediction coefficient and the second prediction coefficient is within a predetermined threshold value.

11. The method according to claim 9, wherein in the computing, a corrected third channel signal is obtained by correcting the third channel signal subjected to prediction encoding using the residual signal, and wherein in the computing, the third prediction coefficient is obtained on the basis of a distribution computed using the first channel signal and the second channel signal of the first frequency range and the corrected third prediction coefficient.

12. The method according to claim 11, wherein the distribution is defined by a predetermined curved surface having a minimum value.

13. The method according to claim 12, wherein the predetermined curved surface is one of a parabolic cylinder surface and an elliptic paraboloid surface.

14. The method according to claim 8, wherein in the prediction decoding, the prediction-encoded third channel signal of the first frequency range is obtained from the first channel signal and the second channel signal, the first prediction coefficient, and the residual signal of the first frequency range.

15. A non-transitory computer-readable storage medium storing an audio decoding program that causes a computer to execute a process, the processing comprising:

decoding, using a first channel signal and a second channel signal included in a plurality of channels of an audio signal having a first frequency range and a second frequency range, a first prediction coefficient of the first frequency range and a second prediction coefficient of the second frequency range, both selected from a code book when prediction-encoding a third channel signal that is not subjected to prediction encoding and that is included in the plurality of channels;

decoding, by a computer processor, a residual signal included in the first frequency range, the residual signal representing an error occurring in prediction encoding; and prediction-decoding the third channel signal subjected to prediction-encoding in the second frequency range from the first channel signal, the second channel signal, the third channel signal subjected to prediction encoding, the first prediction coefficient, and the residual signal of the first frequency range and the first channel signal and the second channel signal of the second frequency range.

16. The non-transitory computer-readable storage medium according to claim 15, further comprising:

computing a third prediction coefficient from the first channel signal, the second channel signal, and the third channel signal subjected to prediction encoding, the first prediction coefficient, and the residual signal of the first frequency range, wherein in the prediction-decoding, the prediction-encoded third channel signal of the second frequency range is obtained from the first channel signal and the second channel signal of the second frequency range and the third prediction coefficient.

17. The non-transitory computer-readable storage medium according to claim 16, wherein in the computing, the third prediction coefficient is computed if each of the first prediction coefficient and the second prediction coefficient is within a predetermined threshold value.

18. The non-transitory computer-readable storage medium according to claim 16, wherein in the computing, a corrected third channel signal is obtained by correcting the third channel signal subjected to prediction encoding using the residual signal, and wherein in the computing, the third prediction coefficient is obtained on the basis of a distribution computed using the first channel signal and the second channel signal of the first frequency range and the corrected third prediction coefficient.

19. The non-transitory computer-readable storage medium according to claim 18, wherein the distribution is defined by a predetermined curved surface having a minimum value.

20. An audio encoding and decoding system comprising:

a processor; and a memory which stores a plurality of instructions, which when executed by the processor, cause the processor to execute, encoding, using a first channel signal and a second channel signal included in a plurality of channels of an audio signal having a first frequency range and a second frequency range, a third channel signal not subjected to prediction encoding included in the plurality of channels by selecting a first prediction coefficient of the first frequency range and a second prediction coefficient of the second frequency range from a code book and encode a residual signal included in the first frequency range, the residual signal representing an error occurring in prediction encoding;

decoding the residual signal;

computing a third prediction coefficient from the first channel signal, the second channel signal, the third channel signal subjected to prediction encoding, the first prediction coefficient, and the residual signal of the first frequency range; and decoding the prediction-encoded third channel signal of the second frequency range from the first channel signal and the second channel signal, and the third prediction coefficient of the second frequency range.

* * * * *